US008828638B2

(12) United States Patent
Fukushima et al.

(10) Patent No.: US 8,828,638 B2
(45) Date of Patent: Sep. 9, 2014

(54) TWO-COMPONENT DEVELOPER, DEVELOPER CARTRIDGE, PROCESS CARTRIDGE AND IMAGE FORMATION APPARATUS

(75) Inventors: Norihito Fukushima, Kanagawa (JP); Manabu Serizawa, Kanagawa (JP); Katsuyuki Kitajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 555 days.

(21) Appl. No.: 12/568,049

(22) Filed: Sep. 28, 2009

(65) Prior Publication Data

US 2010/0248112 A1 Sep. 30, 2010

(30) Foreign Application Priority Data

Mar. 26, 2009 (JP) ..... 2009-077346

(51) Int. Cl.
*G03G 9/113* (2006.01)
*G03G 9/09* (2006.01)

(52) U.S. Cl.
USPC ..... 430/111.34; 430/108.22; 430/111.35

(58) Field of Classification Search
USPC ..... 430/108.22, 111.35, 111.34
See application file for complete search history.

(56) References Cited

U.S. PATENT DOCUMENTS

| | | | | |
|---|---|---|---|---|
| 3,804,619 | A | 4/1974 | Mammino et al. | |
| 4,284,702 | A | 8/1981 | Tabuchi et al. | |
| 5,629,120 | A | 5/1997 | Serizawa et al. | |
| 6,010,811 | A * | 1/2000 | Baba et al. | 430/110.4 |
| 6,124,067 | A * | 9/2000 | Mikuriya et al. | 430/100 |
| 6,440,627 | B2 * | 8/2002 | Shoji et al. | 430/108.1 |
| 6,653,040 | B2 * | 11/2003 | Ohba et al. | 430/111.32 |
| 2005/0070631 | A1 | 3/2005 | Itakura et al. | |
| 2006/0240350 | A1 * | 10/2006 | Shu et al. | 430/108.6 |
| 2008/0171281 | A1 * | 7/2008 | Kobayashi et al. | 430/111.31 |

FOREIGN PATENT DOCUMENTS

| | | | |
|---|---|---|---|
| CN | 101377627 | A | 3/2009 |
| EP | 1 327 914 | A2 | 7/2003 |
| EP | 1 329 774 | A2 | 7/2003 |
| JP | A-49-91231 | | 8/1974 |
| JP | A-56-40868 | | 4/1981 |
| JP | B2-59-24416 | | 6/1984 |
| JP | A-5-100493 | | 4/1993 |
| JP | B2-8-3679 | | 1/1996 |
| JP | A-8-129272 | | 5/1996 |
| JP | A-2005-17838 | | 1/2005 |
| JP | 2006154806 | A * | 6/2006 |
| JP | A-2007-248746 | | 9/2007 |
| JP | A-2008-122868 | | 5/2008 |

(Continued)

OTHER PUBLICATIONS

Aug. 2, 2011 Office Action issued in Japanese Application No. 2009-077346 (with translation).

(Continued)

*Primary Examiner* — Jonathan Jelsma
(74) *Attorney, Agent, or Firm* — Oliff PLC

(57) ABSTRACT

A two-component developer including a yellow toner and a carrier, the yellow toner including at least one of C. I. Pigment Yellow 155 or C. I. Pigment Yellow 185, and an azo pigment, the carrier including a first resin, magnetic particles dispersed in the first resin, and elements of Cu, Zn, Ni and Mn each in an amount of from 0 to about 2,000 ppm.

19 Claims, 2 Drawing Sheets

(56) References Cited

FOREIGN PATENT DOCUMENTS

| | | | |
|---|---|---|---|
| JP | A-2008-191566 | | 8/2008 |
| JP | A-2008-258789 | | 10/2008 |
| JP | A-2010-039173 | | 2/2010 |
| WO | WO 2008/123624 | A1 | 10/2008 |

OTHER PUBLICATIONS

Extended European Search Report issued in European Patent Application No. 09172928.5 dated Jul. 9, 2010.
Mar. 26, 2012 Chinese Office Action issued in Chinese Patent Application No. 200910179525.5 (with English-language translation).

* cited by examiner

TWO-COMPONENT DEVELOPER, DEVELOPER CARTRIDGE, PROCESS CARTRIDGE AND IMAGE FORMATION APPARATUS

CROSS-REFERENCE TO RELATED APPLICATION

This application based on and claims priority under 35 USC 119 from Japanese Patent Application No. 2009-077346 filed Mar. 26, 2009.

BACKGROUND

1. Technical Field

The present invention relates to a two-component developer, a developer cartridge, a process cartridge and an image formation apparatus.

2. Related Art

Currently, methods of visualizing image information through an electrostatic latent image such as an electrophotographic method or the like are used in a wide variety of fields. In the electrophotographic method, an electrostatic latent image formed on the surface of a photoreceptor (latent image holding unit) is developed with a developer including an electrostatic latent image developing toner (hereinafter, simply referred to as a "toner") through a charging process, an exposure process or the like, and the electrostatic latent image is visualized through a transfer process, a fixing process and the like.

As the toners used in such an electrophotographic method, for example, yellow toners employing a high-grade colorant such as C. I. Pigment Yellow 155, C. I. Pigment Yellow 185 or the like are disclosed.

SUMMARY

According to an aspect of the invention, there is provided a two-component developer comprising a yellow toner and a carrier, the yellow toner comprising at least one of C. I. Pigment Yellow 155 or C. I. Pigment Yellow 185, and an azo pigment, the carrier comprising a first resin, magnetic particles dispersed in the first resin, and elements of Cu, Zn, Ni and Mn each in an amount of from 0 to about 2,000 ppm.

BRIEF DESCRIPTION OF THE DRAWINGS

Exemplary embodiments of the present invention will be described in detail based on the following figures, wherein.

DETAILED DESCRIPTION

Figure 1:
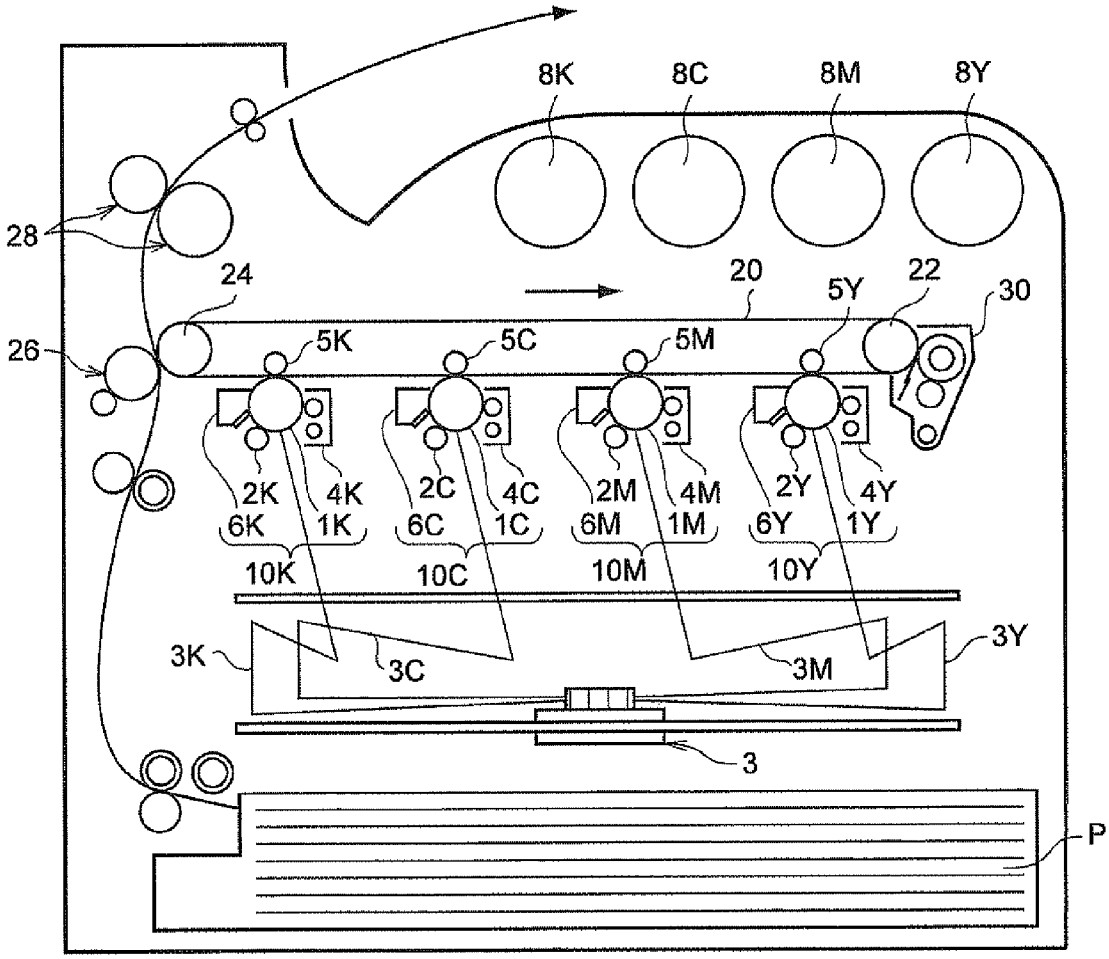
FIG. 1 is a schematic drawing showing an example of an image formation apparatus according to the invention.

Hereinafter, the present invention will be explained in detail. In the following, the expression "A to B" includes not only the range between A and B, but also includes A and B which are the upper and lower limits of the range, respectively. For example, when "A to B" is a numerical range, the "A to B" represents "A or more and B or less" or "B or more and A or less".

Two-Component Developer

The two-component developer of an exemplary embodiment of the invention includes a yellow toner and a carrier. Further, the yellow toner includes at least one of C. I. Pigment Yellow 155 (hereinafter, may be referred to as "PY 155") or C. I. Pigment Yellow 185 (hereinafter, may be referred to as "PY 185"), and an azo pigment. Furthermore, the carrier includes a resin and magnetic particles dispersed in the resin, and the contents of Cu element, Zn element, Ni element and Mn element included in the carrier are each in an amount of from 0 to 2,000 ppm or less, or from 0 to about 2,000 ppm or less. The amount of each element refers to the total amount included in a simple substance thereof and a compound formed together with other elements.

When the two-component developer of the present exemplary embodiment has the above composition, an image having excellent light-fastness can be obtained. The reason for this is not necessarily clear, but can be presumed as follows:

In order to improve the coloring ability and achieve a color hue close to a yellow color as specified in the Japan Color, a color standard, the toner of the present exemplary embodiment includes at least one of PY 155 or PY 185, and an azo pigment, as the colorants in combination. Although PY 155 and PY 185 are pigments that exhibit an excellent color tone, these pigments have a somewhat weak coloring ability. Further, PY 155 and PY 185 exhibit a rather greenish yellow color that assumes a color hue different from the yellow color as specified in the Japan Color. As a result of studies on the combined use of these pigments with other pigments, it has been found that a combination of PY 155 or PY 185 and an azo pigment achieves excellent coloring ability and color hue. On the other hand, however, there has been room for improvements in terms of light-fastness of this combination. In this regard, for example, when elements of Cu, Zn, Ni and Mn (hereinafter, may be referred to as a "specific metal species", respectively) included in a carrier are mixed in a toner and an image is formed from the toner, these elements are considered to affect the light-fastness of the image. More specifically, for example, an active species (for example, a radical) is generated upon irradiation with ultraviolet rays in the presence of the specific metal species and oxygen, and this active species is considered to destroy a certain kind of functional group (for example, an azo group) in the colorant (in particular, an azo pigment), thereby causing deterioration of the image.

In view of the above, the toner according to the present exemplary embodiment employs a carrier that includes a limited amount of the specific metal species as mentioned above. Therefore, it can be presumed that inclusion of the specific metal species in the toner does not easily occur even if the carrier is cracked or chipped as a result of performing an image formation process over a long period of time, thereby suppressing the deterioration of the light-fastness of an image.

In the present exemplary embodiment, resin particles in which magnetic particles are dispersed (hereinafter, may be referred to as "magnetic particle-dispersed resin particles") are used as a carrier (magnetic particle-dispersed carrier). This carrier has a superior impact resistance and a small specific gravity, as compared with a carrier not containing magnetic particle-dispersed resin particles (for example, a ferrite carrier formed of calcinated ferrite particles per se, or a carrier prepared by forming a coating layer on the ferrite carrier, or the like), and is thus less likely to be affected by an impact. Further, since this carrier has a smooth surface and a highly spherical shape, an impact caused by friction is less likely to occur due to its high degree of fluidity. As a result, it is presumed that the carrier is not easily cracked or chipped, and the specific metal species included in the carrier is less likely to be mixed in the toner, thereby suppressing degradation in light-fastness of the image formed from the toner. Moreover, since a magnetic particle-dispersed carrier has a small specific gravity as compared with that of a carrier not including magnetic particle-dispersed resin particles, the carrier is less susceptible to an agitation stress. Therefore, even when the carrier is used together with, a toner having an externally-added external additive, embedding of the external additive may be suppressed. Accordingly, the chargeability of the toner may be maintained, and excellent transfer efficiency, gradation image reproducibility, thin line reproducibility or the like may be achieved.

Hereinafter, each component of the two-component developer will be described.

<Yellow Toner>

As described in the above, the yellow toner includes at least one of PY 155 or PY 185, and an azo pigment, as the colorants. The yellow toner may further include other colorants, as needed. Moreover, the yellow toner may also include a binder resin or a release agent, and may also include other components, as needed.

—Colorant—

The yellow toner may include only one of PY 155 or PY 185, or may include both PY 155 and PY 185. Although PY 155 and PY 185 exhibit excellent light-fastness, these colorants are highly cohesive. In this regard, by using an azo pigment in combination, cohesion of these colorants can be suppressed and the color-forming property thereof can be exhibited.

Both PY 155 and PY 185 are yellow colorants, and are compounds represented by the following Formula (1) and Formula (2), respectively.

Formula (1): RY 155

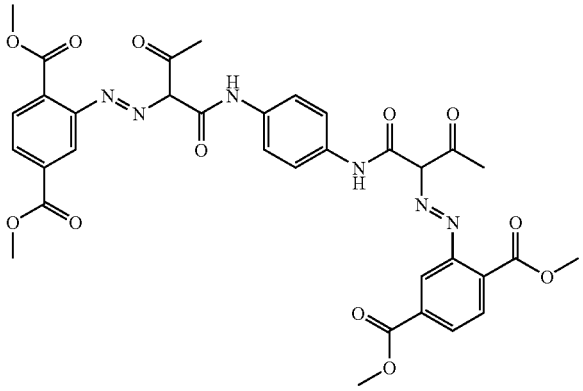

-continued

Formula (2): PY 185

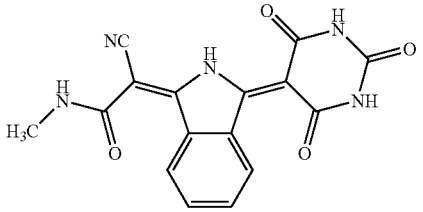

The azo pigment is not specifically restricted as long as it is a yellow pigment having one or more azo (—N═N—) groups. Examples of the azo pigment include a monoazo pigment, a disazo pigment, and an azo-lake pigment. Among these, it is preferable to use at least one of monoazo pigment or disazo pigment, more preferably a monoazo pigment, and particularly preferably C. I. Pigment Yellow 74 (hereinafter, may be referred to as "PY 74").

Specific examples of the azo pigments include the monoazo pigments such as C. I. Pigment Yellow 74 (represented by the following Formula (3)), C. I. Pigment Yellow 1, C. I. Pigment Yellow 2, C. I. Pigment Yellow 3, C. I. Pigment Yellow 5, C. I. Pigment Yellow 6, C. I. Pigment Yellow 49, C. I. Pigment Yellow 65, C. I. Pigment Yellow 73, C. I. Pigment Yellow 75, C. I. Pigment Yellow 97, C. I. Pigment Yellow 98, C. I. Pigment Yellow 111, C. I. Pigment Yellow 116 and C. I. Pigment Yellow 130; and the disazo pigments such as C. I. Pigment Yellow 93 (represented by the following Formula (4)), C. I. Pigment Yellow 12, C. I. Pigment Yellow 13, C.I. Pigment Yellow 14, C. I. Pigment Yellow 17, C.I. Pigment Yellow 55, C. I. Pigment Yellow 63, C.I. Pigment Yellow 81, C. I. Pigment Yellow 83, C.I. Pigment Yellow 87, C.I. Pigment Yellow 90, C.I. Pigment Yellow 94, C. I. Pigment Yellow 95, C. I. Pigment Yellow 106, C.I. Pigment Yellow 113, C.I. Pigment Yellow 114, C. I. Pigment Yellow 121, C.I. Pigment Yellow 124, C. I. Pigment Yellow 126, C.I. Pigment Yellow 127, C.I. Pigment Yellow 128, C. I. Pigment Yellow 136, C.I. Pigment Yellow 152, C.I. Pigment Yellow 166, C. I. Pigment Yellow 170, C.I. Pigment Yellow 171, C. I. Pigment Yellow 172, C. I. Pigment Yellow 174, C. I. Pigment Yellow 176 and C. I. Pigment Yellow 188.

Formula (3): C. I. Pigment Yellow 74

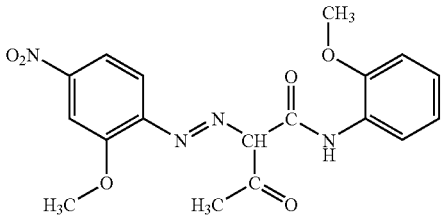

Formula (4): C. I. Pigment Yellow 93

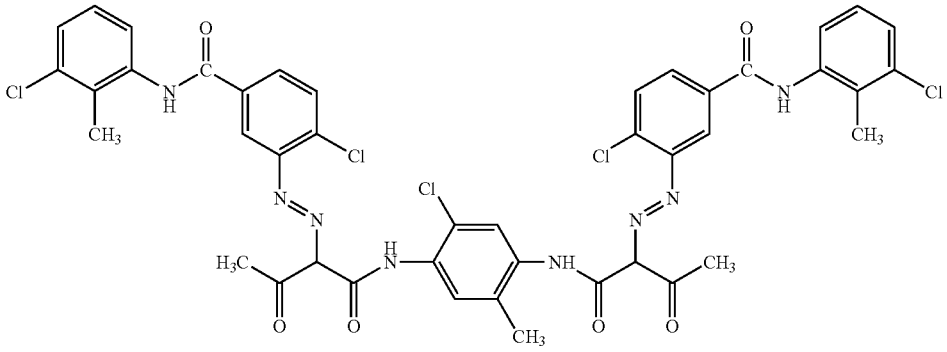

The yellow toner may also include other colorants in addition to the above colorants, as needed. However, the yellow toner preferably only includes at least one of PY 155 or PY 185 and an azo pigment.

The total content of the colorants in the yellow toner is preferably in the range of from 0.1 parts by weight or about 0.1 parts by weight to 20 parts by weight or about 20 parts by weight, and more preferably in the range of from 0.5 parts by weight to 10 parts by weight, with respect to 100 parts by weight of the yellow toner.

Further, the content ratio of PY 155 and/or PY 185 to the azo pigment in the yellow toner (PY 155 and/or PY 185:azo pigment) is preferably 99.5:0.5 or about 99.5:0.5 to 5:95 or about 5:95, and more preferably 95:5 to 80:20. When the content ratio is within the above range, a yellow toner having excellent coloring ability, color tone and durability over a long period of time may be obtained.

—Binder Resin—

The yellow toner preferably includes a binder resin.

The binder resin may be any kwon resins used for the conventional toners, and examples of the resins include polycondensation resins and addition-polymerization resins. Among them, styrene-acrylic resins, polyester resins and epoxy resins are preferred, and styrene-acrylic resins and polyester resins are more preferred. The binder resin may be used alone or in combination of two or more kinds.

Preferable examples of the polycondensation resin include polyester resins and polyamide resins. Among them, polyester resins obtained by using a polycondensable monomer including a polycarboxylic acid and a polyol are particularly preferable.

Examples of the polycondensable monomers include a polyvalent carboxylic acid, a polyol, a hydroxycarboxylic acid, a polyamine, and a mixture thereof. In particular, the polycondensable monomer is preferably a polyvalent carboxylic acid and a polyol, or an ester compound thereof (an oligomer or a prepolymer), more preferably those that form a polyester resin through direct esterification or transesterification. In this case, the polyester resin obtained by polymerization may be either an amorphous polyester resin (non-crystalline polyester resin) or a crystalline polyester resin, or may be a mixed form thereof.

Although the polycondensation resin can be obtained by performing polycondensation of at least one selected from the group consisting of a polycondensable monomer, an oligomer thereof and a prepolymer thereof, but a polycondensabale monomer is particularly preferred.

The polyvalent carboxylic acid is a compound including two or more carboxyl groups in one molecule. Among them, dicarboxylic acid is a compound including two carboxyl groups in one molecule. Examples of the dicarboxylic acid include oxalic acid, succinic acid, glutaric acid, maleic acid, adipic acid, β-methyl adipic acid, azelaic acid, sebacic acid, nonane dicarboxylic acid, decane dicarboxylic acid, undecane dicarboxylic acid, dodecane dicarboxylic acid, fumaric acid, citraconic acid, diglycolic acid, cyclohexane-3,5-diene-1,2-carboxylic acid, hexahydroterephthalic acid, malonic acid, pimelic acid, sberic acid, phthalic acid, isophthalic acid, terephthalic acid, tetrachlorophthalic acid, chlorophthalic acid, nitrophthalic acid, p-carboxyphenylacetic acid, p-phenylene diacetic acid, m-phenylene diacetic acid, o-phenylene diacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and cyclohexane dicarboxylic acid.

Further, examples of the polyvalent carboxylic acid other than the dicarboxylic acid include trimellitic acid, trimesic acid, pyromellitic acid, naphthalene tricarboxylic acid, naphthalene tetracarboxylic acid, pyrene-tricarboxylic acid, pyrene-tetracarboxylic acid, itaconic acid, glutaconic acid, n-dodecylsuccinic acid, n-dodecenyl succinic acid, isododecyl succinic acid, isododecenyl succinic acid, n-octyl succinic acid, n-octenyl succinic acid, and a lower ester of these polyvalent carboxylic acids. Further, acid halides, acid anhydrides or the like of these polyvalent carboxylic acids may also be used. These compounds may be used alone or in combination of two or more kinds.

The lower ester as mentioned above refers to an ester having an alkoxy moiety including 1 to 8 carbon atoms. Specific examples thereof include a methyl ester, an ethyl ester, an n-propyl ester, an isopropyl ester, an n-butyl ester and an isobutyl ester.

The polyol is a compound having two or more hydroxyl groups in one molecule. Among them, a diol is a compound having two hydroxyl groups in one molecule, and specific examples thereof include ethylene glycol, diethylene glycol, triethylene glycol, 1,2-propylene glycol, 1,3-propylene glycol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, 1,14-eicosanedecane diol, diethylene glycol, triethylene glycol, dipropyrene glycol, polyethylene glycol, polypropylene glycol, polytetramethylene ether glycol, 1,4-cyclohexane diol, 1,4-cyclohexane dimethanol, 1,4-butene diol, neopentyl glycol, 1,4-cyclohexane diol, polytetramethylene glycol, hydrogenated bisphenol A, bisphenol A, bisphenol F, bisphenol S, and an alkylene oxide adduct of these bisphenols (alkylene oxides include ethylene oxide, propylene oxide, butylene oxide and the like). Among them, an alkylene glycol having 2 to 12 carbon atoms and an alkylene oxide adduct of a bisphenol are preferable, and an alkylene oxide adduct of a bisphenol and a combined use of the same with an alkylene glycol having 2 to 12 carbon atoms are particularly preferable.

Further, in order to promote the dispersibility in water of the binder resin, for example, 2,2-dimethylol propionic acid, 2,2-dimethylol butanoic acid, 2,2-dimethylol valeric acid, or the like may be used as a diol.

Examples of the alcohol of trivalent or more include glycerin, trimethylol ethane, trimethylol propane, pentaerythritol, hexamethylol melamine, hexaethylol melamine, tetramethylol benzaguanamine, tetraethylol benzoguanamine, sorbitol, trisphenol PA, phenol novolak, cresol novolak, and an alkylene oxide adduct of these alcohols of trivalence or more. These compounds may be used alone or in combination of two or more kinds.

By selecting the combination of these polycondensable monomers as mentioned above, either a non-crystalline resin or a crystalline resin may be obtained with ease.

Examples of the crystalline polyester resin obtained by using the aforementioned polycondensable monomers include a polyester obtained by reacting 1,9-nonane diol with 1,10-decane dicarboxylic acid, or by reacting cyclohexane diol with adipic acid; a polyester obtained by reacting 1,6-hexane diol with sebacic acid; a polyester obtained by reacting ethylene glycol with succinic acid; a polyester obtained by reacting ethylene glycol with sebacic acid; and a polyester obtained by reacting 1,4-butanediol with succinic acid. Among them, a polyester obtained by reacting 1,9-nonane diol with 1,10-decane dicarboxylic acid, and a polyester obtained by reacting 1,6-hexane diol with sebacic acid are still more desirable, but the polyester are not limited thereto.

Examples of the hydroxycarboxylic acid include hydroxyheptanoic acid, hydroxyoctanoic acid, hydroxydecanoic acid, hydroxyundecanoic acid, malic acid, tartaric acid, mucic acid, and citric acid.

Examples of the polyamine include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine, and 1,4-cyclohexane-bis (methylamine).

The weight average molecular weight of the polycondensation resin is preferably in the range of from 1,500 or about 1,500 to 40,000 or about 40,000, and more preferably in the range of from 3,000 to 30,000. When the weight average molecular weight is 1,500 or more, the resin may exhibit a favorable cohesive force and an excellent hot-offset property. When the weight average molecular weight is 40,000 or less, the resin may exhibit an excellent hot-offset property while achieving a favorable value of minimum fixation temperature. Moreover, the polycondensation resin may have a branched structure or a cross-linked structure, by appropriately selecting the number of carboxylic acid in the monomer, the valence of the alcohol, or the like.

The acid number of the polyester resin is preferably in the range of from 1 mg·KOH/g or about 1 mg·KOH/g to 50 mg·KOH/g or about 50 mg·KOH/g. In order to produce a toner that can be used in practical applications for forming a high-definition image, the particle size and the particle size distribution of the toner in an aqueous medium need to be controlled. When the acid number is 1 mg·KOH/g or more, the particle size and the particle size distribution that are sufficient enough can be obtained in the particle-forming process, and when such a polyester resin is used in the toner, a sufficient degree of chargeability of the toner can be achieved. Furthermore, when the acid number is 50 mg·KOH/g or less, the molecular weight of the resin may be large enough to produce a toner during polycondensation that achieves a sufficient level of image strength. Further, the chargeability of a toner at hot and humid conditions may be less dependent on the environment, thereby forming images in a highly reliable manner.

The acid number can be measured by a neutralization-titration method, in accordance with JIS K0070. More specifically, a sample is added to 100 ml of a solvent (a mixed solution of diethyl ether/ethanol) and a few drops of an indicator (a phenolphthalein solution) are added thereto, and the mixture is sufficiently shaken on a water bath until the sample is dissolved in the mixture. Then, the solution is titrated with a 0.1 mol/l potassium hydroxide/ethanol solution, and the time at which a red color of the indicator appears for 30 seconds is determined as an end point. The acid number A is calculated from the following equation, where S is the amount of sample (g), B is the amount of 0.1 mol/l potassium hydroxide ethanol solution used for the titration (ml), and f is a factor of the 0.1 mol/l potassium hydroxide ethanol solution.

$$A=(B\times f\times 5.611)/S$$

Examples of the addition-polymerizable monomers used for the manufacture of an addition polymerization resin include a cationic polymerizable monomer, an anionic polymerizable monomer and a radical polymerizable monomer, but a radical polymerizable monomer is preferred.

Examples of the radical polymerizable monomer include styrene monomers, unsaturated carboxylic acids and (meth) acrylates (the term "(meth)acrylates" refers to both acrylates and methacrylates, hereinafter the same in this description), N-vinyl compounds, vinyl esters, halogenated vinyl compounds, N-substituted unsaturated amides, conjugated dienes, polyfunctional vinyl compounds and polyfunctional (meth)acrylates.

The obtained polymer may be crosslinked by using N-substituted unsaturated amides, conjugated dienes, polyfunctional vinyl compounds, polyfunctional (meth)acrylates or the like. The radical polymerizable monomer may be used alone or in combination of two or more kinds.

Further, the radical polymerizable monomer is preferably a compound having an ethylenic unsaturated bond, and examples thereof include aromatic ethylenic unsaturated compounds (hereinafter referred to as a "vinyl aromatic compound" sometimes), carboxylic acids having an ethylenic unsaturated bond (unsaturated carboxylic acid), derivatives of unsaturated carboxylic acids such as esters, aldehydes, nitriles or amides, N-vinyl compounds, vinyl esters, halogenated vinyl compounds, N-substituted unsaturated amides, conjugated dienes, polyfunctional vinyl compounds and polyfunctional (meth)acrylates.

Examples of the radical polymerizable monomer include vinyl aromatic compounds, including unsubstituted vinyl aromatic compounds such as styrene or p-vinyl pyridine, α-substituted styrene such as α-methyl styrene or α-ethyl styrene, aromatic-nucleus substituted styrene such as m-methyl styrene, p-methyl styrene or 2,5-dimethyl styrene, and aromatic-nucleus halogen-substituted styrenes such as p-chlorostyrene, p-bromostyrene or dibromostyrene; (meth) acrylic acids (the term "(meth)acrylic" refers to both acrylic and methacrylic, hereinafter the same); unsaturated carboxylic acids such as crotonic acid, maleic acid, fumaric acid, citraconic acid or itaconic acid; unsaturated carboxylates such as methyl(meth)acrylate, ethyl(meth)acrylate, propyl(meth)acrylate, butyl(meth)acrylate, pentyl(meth)acrylate, hexyl(meth)acrylate, 2-ethylhexyl(meth)acrylate, glycidyl (meth)acrylate or benzyl(meth)acrylate; unsaturated carboxylic acid derivatives such as (meth)acryl aldehyde, (meth) acrylonitrile or (meth)acrylamide; N-vinyl compounds such as N-vinyl pyridine or N-vinyl pyrrolidone, vinyl esters such as vinyl formate, vinyl acetate or vinyl propionate; halogenated vinyl compounds such as vinyl chloride, vinyl bromide or vinylidene chloride; N-substituted unsaturated amides such as N-methylol acrylamide, N-ethylol acrylamide, N-propanol acrylamide, N-methylol maleamidic acid, N-methylol maleamidic ester, N-methylol maleimide or N-ethylol maleimide; conjugated dienes such as butadiene or isoprene; polyfunctional vinyl compounds such as divinylbenzene, divinyl naphthalene or divinyl cyclohexane; and polyfunctional acrylates such as ethyleneglycol di(meth)acrylate, diethyleneglycol di(meth)acrylate, propylene glycol di(meth)acrylate, tetramethyleneglycol di(meth)acrylate, neopentyl glycol di(meth)acrylate, hexamethyleneglycol di(meth)acrylate, trimethylolpropane di(meth)acrylate, trimethylolpropane tri(meth)acrylate, glycerol di(meth)acrylate, glycerol tri(meth)acrylate, pentaerythritol di(meth)acrylate, pentaerythritol tri(meth)acrylate, pentaerythritol tetra(meth) acrylate, dipentaerythritol di(meth)acrylate, dipentaerythritol tri(meth)acrylate, dipentaerythritol tetra(meth)acrylate, dipentaerythritol penta(meth)acrylate, dipentaerythritol hexa (meth)acrylate, sorbitol tri(meth)acrylate, sorbitol tetra (meth)acrylate, sorbitol penta(meth)acrylate or sorbitol hexa (meth)acrylate. Further, sulfonic acids or phosphonic acids having an ethylenic unsaturated bond, or a derivative thereof may be used. Among them, N-substituted unsaturated amides, conjugated dienes, polyfunctional vinyl compounds and polyfunctional (meth)acrylates have an ability of causing a crosslinking reaction of the obtained polymer. The radical polymerizable monomers may be used alone or in combination of two or more kinds.

When a non-crystalline resin is used as the binder resin, the glass transition temperature Tg of the non-crystalline resin is preferably from 50° C. to 80° C., and more preferably from 50° C. to 65° C. When the Tg is 50° C. or more, the resin may exhibit an excellent hot-offset property upon fixation, due to a favorable cohesive force of the binder resin by itself in a high temperature range. When the Tg is 80° C. or less, the binder resin may sufficiently melt, and the minimum fixing temperature thereof is not easily increased.

The glass transition temperature of the binder resin here refers to a value as measured by a method as specified in ASTM D3418-82 (DSC method).

The content of the binder resin with respect to the total weight of the yellow toner is preferably from 10% by weight or about 10% by weight to 90% by weight or about 90% by weight, more preferably from 30% by weight to 85% by weight, still more preferably from 50% by weight to 80% by weight.

—Release Agent—

The yellow toner preferably includes a release agent. The release agent is typically used for the purpose of improving the releasing property of the toner.

Specific examples of the release agent include low molecular weight polyolefins such as polyethylene, polypropylene or polybutene; silicones that is softened by heating; fatty acid amides such as oleic acid amide, erucic acid amide, ricinolic acid amide or stearic acid amide; vegetable waxes such as carnauba wax, rice wax, candelilla wax, Japan tallow or Jojoba oil; animal waxes such as beeswax; mineral and petroleum waxes such as Montan wax, ozokerite, ceresin, paraffin wax, microcrystalline wax or Fischer-Tropsch wax, and ester waxes such as fatty acid esters, montanates or carboxylates. These release agents may be used alone or in combination of two or more kinds.

The content of the release agent with respect to the total amount of the yellow toner is preferably from 0.5% by weight to 50% by weight, more preferably from 1% by weight to 30% by weight, and still more preferably from 5% by weight to 15% by weight. When the content is 0.5% by weight or more, effects of adding the release agent can be sufficiently achieved. When the content of the release agent is 50% by weight or less, the obtained toner exhibits a favorable chargeability and is less likely to be broken, thereby suppressing spenting of the release agent into the carrier and achieving favorable charge maintainability. The spenting refers to a phenomenon that a substance such as a release agent attaches to a surface of the carrier, whereby a toner is not sufficiently charged upon contact with the carrier. In the case of a color toner, a sufficient amount of the release agent is discharged to an image surface upon fixation. Therefore, the release agent is less likely to remain in the image, thereby achieving excellent transparency.

—Other Components—

Other components included in the yellow toner are not specifically restricted and may be selected in accordance with the intended use. For example, various known additives such as a charge control agent or the like may be used.

The charge control agent is typically used for the purpose of enhancing the chargeability.

Examples of the charge control agent include metal salts of salicylic acid, metal-containing azo compounds, Nigrosine, quaternary ammonium salts and the like.

—External Additive—

A known external additive may be externally added to the yellow toner.

Examples of the external additive include inorganic particles of silica, alumina, titania and the like. For example, inorganic particles of silica, alumina, titania or calcium carbonate, or resin particles of vinyl resin, polyester or silicone may be used as a flowability aid or a cleaning aid. Although the method of adding an external additive to the toner is not specifically restricted, one example is a method of applying a shearing force in a dry state to add the external additive to the surface of toner particles.

The primary particle size of the inorganic particles is preferably in the range of from 5 nm or about 5 nm to 1 μm or about 1 μm, and is more preferably in the range of from 5 nm to 500 nm. Two or more kinds of inorganic particles may be used in combination, as needed. In particular, an external additive having a mean particle size of 100 μm or more is useful since it has a weak adhesive force to the toner particles and is less likely to change its structure when used over a long period of time, and further, are useful in view of maintaining the structure of particles having a smaller diameter.

The specific surface area of the external additive as measured by a BET method is preferably in the range of from 20 $m^2/g$ or about 20 $m^2/g$ to 5.00 $m^2/g$ or about 500 $m^2/g$. The measurement of the specific surface area by the BET method can be performed by a nitrogen replacement method. More specifically, the specific surface area can be measured by a three-point method using a specific surface area measuring device (SA3100, trade name, manufactured by Beckman Coulter Inc.)

The content of the external additive in the toner is preferably in the range of from 0.01% by weight to 5% by weight, and more preferably in the range of from 0.01% by weight to 2.0% by weight.

A silica powder used as an external additive is a powder having an Si—O—Si bond, and there are silica powders manufactured by a dry process and a wet process. The silica powder may be formed of aluminum silicate, sodium silicate, potassium silicate, zinc silicate or the like, as well as anhydrous silicon dioxide, but preferably contains $SiO_2$ in an amount of 85% by weight or more.

Although various kinds of silica are commercially available as specific examples of the silica powder, a silica powder having a hydrophobic group on a surface thereof is preferable. Examples of such a silica powder include AEROSIL R-972, AEROSIL R-974, AEROSIL R-805 and AEROSIL R-812 (trade names, manufactured by Nippon Aerosil Co., Ltd.) and TARANOX 500 (trade name, manufactured by Talco Co., Ltd.). Further, a silica powder treated with a silane coupling agent, a titanium coupling agent, silicone oil, or a silicone oil having an amine in its side chain are also applicable as the silica powder.

—Characteristics of Yellow Toner—

The volume average particle size of the yellow toner particles is preferably from 2 μm or about 2 μm to 10 μm or about 10 μm, and is more preferably from 3 μm to 8 μm. Further, the number average particle size of the yellow toner particles is preferably from 2 μm to 10 μm, and is more preferably from 3 μm to 8 μm.

The volume average particle size and number average particle size can be determined, for example, by using a particle size analyzer COULTER MULTISIZER II (trade name, manufactured by Beckman Coulter, Inc.) with an aperture size of 50 μm. In this case, the measurement is preferably conducted after dispersing the toner in an aqueous electrolytic solution (aqueous solution of ISOTON, trade name, manufactured by Beckman Coulter, Inc.) and applying ultrasonic waves for 30 seconds or more.

—Method of producing Yellow Toner—

Although yellow toners may be produced by known methods of producing a toner, the yellow toners are preferably produced by a so-called wet process, namely, a method including a process of producing toner mother particles containing at least a colorant and a binder resin, in water, an organic solvent, or a mixed solvent thereof; and a process of washing and drying the toner mother particles. Although a toner manufactured by a knead-and-pulverizing process may achieve satisfactory effects, there is a problem in that the toner obtained by this method may cause unevenness in an image during development or transferring, particularly in an image of a green color or the like.

The wet process is not particularly restricted, but examples thereof include: (1) a suspension-polymerization method in which a polymerizable monomer that forms a binder resin is suspended together with a colorant and an optional component such as a release agent, and then the polymerizable monomer is polymerized; (2) a dissolution suspension method in which toner components such as a binder resin and a colorant are dissolved in an organic solvent and this is dispersed in an aqueous solvent, and then the organic solvent is removed therefrom; and (3) an emulsification polymerization aggregation method in which a binder resin component as prepared by emulsification polymerization is subjected to hetero-aggregation together with a dispersion of a colorant or the like, and then the resultant is fused.

In addition, other examples of the wet processes include (4) a method in which a binder resin component such as a resin obtained by bulk polymerization is dispersed in an aqueous medium together with a surfactant using a mechanical shear force to prepare a resin particle dispersion, and this resin particle dispersion is subjected to hetero-aggregation together with a dispersion of a colorant or the like, and then the heteroaggregated product is fused.

The yellow toner is preferably manufactured by a method including: a process of preparing a raw material dispersion, the raw material dispersion being obtained by mixing at least a resin particle dispersion prepared by dispersing a binder resin (resin particles) in an aqueous medium and a colorant dispersion prepared by dispersing a colorant (colorant particles) in an aqueous dispersion; a process of forming aggregated particles in the raw material dispersion; and a process of fusing (coalescing) the aggregated particles by heating the raw material dispersion in which the aggregated particles are formed to a temperature of at least the glass transition temperature of the binder resin (or at least the melting point of the binder resin). According to this process, aggregation of the dispersed pigment particles (colorant particles) in the aggregation process or the coalescence process can be suppressed, and the pigment can be dispersed in the toner mother particles in a favorable manner. When a pigment is dispersed by a process using a polymerizable monomer or an organic solvent, PY 155 or PY 185 is easily aggregated, and thus it is difficult to obtain a high degree of color saturation.

Here, the method of producing a toner including an aggregation process and a fusing process (a coalescence process) is also referred to as an "aggregation coalescence method".

As necessary, a release agent dispersion in which a release agent (release agent particles) is dispersed therein, an inorganic particle dispersion or the like may be added to the raw material dispersion.

Further, as described in the above, the resin particle dispersion may be prepared by an emulsion polymerization method, or by a dissolution suspension method subsequent to a bulk polymerization process. Furthermore, the resin particle dispersion may be prepared by dispersing the same together with a surfactant by applying a mechanical shear force thereto.

Hereinafter, details of the aggregation coalescence method as an example of the method of producing a yellow toner will be described.

When the yellow toner is produced by the aggregation coalescence method, the toner is produced at least through an aggregation process and a fusing process (a coalescence process), as mentioned above. As necessary, the method may further include an adhesion process in which resin particles are attached to a surface of the aggregated particles (core particles) to form aggregated particles having a core/shell structure.

In the aggregation process, the aggregated particles are formed in the raw material dispersion in which the resin particle dispersion, the colorant dispersion and other optional dispersions are mixed. The particles of at least one of PY 155 or PY 185 and the particles of an azo pigment may be included in a single colorant dispersion, or in separate colorant dispersions.

The median diameter of the colorant particles is preferably from 100 nm to 330 nm. In addition, for example, the median diameter of the colorant particles can be measured by a laser diffraction particle size distribution analyzer (LA-700, trade name, manufactured by Horiba, Ltd.)

The method of dispersing the colorant particles is not particularly limited, and examples thereof include common dispersing methods using a rotative shear-type homogenizer, or using a ball mill, a sand mill, a DYNO-MILL or the like, together with media. Further, the colorant particles may be added to a mixed solvent (raw material dispersion) at the same time as the other particle components, or may be added in multiple steps.

In the aggregation process, specifically, the raw material dispersion obtained by mixing the dispersions is heated so as to allow the particles to aggregate.

The aggregated particles may be formed by adding a flocculant to the dispersion while stirring the same using a rotative shear-type homogenizer, more specifically, at a temperature of 20° C. to 30° C., thereby making the pH of the raw material dispersion acidic.

The flocculant used for the aggregation process is preferably an inorganic metal salt. Examples of the inorganic metal salt include metal salts such as barium chloride, zinc chloride, aluminum chloride or aluminum sulfate, or inorganic metal salt polymers such as polyaluminum chloride or polyaluminum hydroxide. Further, metal salts such as calcium chloride, calcium nitrate or magnesium chloride, and inorganic metal salts such as calcium polysulfide or the like are preferably used.

In the aggregation process, it is preferred to prepare an aqueous solution of the inorganic metal salt, and allow different kinds of particles to aggregate at the same time. In this way, the inorganic metal salt may effectively act on the terminal ends of the molecular chain of the binder resin, and contribute to the formation of a crosslinked structure.

In the aggregation process, the inorganic particle dispersion may be added to the raw material dispersion in a stepwise manner, or may be added in a continuous manner. By adding the inorganic particle dispersion to the raw material dispersion in several steps or in a continuous manner during the aggregation process, the metal ion components in the inorganic particle dispersion are dispersed from the surface of toner particles to the inside thereof. When the inorganic particle dispersion is added in a stepwise manner, the dispersion is preferably added in three steps or more, and when the inorganic particle dispersion is added in a continuous manner, the dispersion is preferably added at a speed of 0.1 g/m or less.

The inorganic particle dispersion may be prepared by, for example, using a ball mill, a sand mill, an ultrasonic dispersing machine, a rotative shear-type homogenizer or the like, and the dispersed average particle size of the inorganic particles is preferably in the range of from 100 nm to 500 nm.

Further, although the addition amount of the inorganic particle dispersion may vary depending on the desired type of metal or the desired degree of formation of a crosslinked structure, it is preferably in the range of from 0.5 parts by weight to 10 parts by weight, and more preferably in the range of from 1 part by weight to 5 parts by weight, with respect to 100 parts by weight of the binder resin component. Therefore, the inorganic particle dispersion is preferably added such that the inorganic particles are added in an amount of the above range (preferably from 0.5 parts by weight to 10 parts by weight, more preferably from 1 part by weight to 5 parts by weight) with respect to 100 parts by weight of the resin particles in the raw material dispersion.

After the aggregation process, an attachment process may be carried out, as necessary. In the attachment process, a coating layer is further formed by attaching resin particles to a surface of the aggregated particles that are formed through the aggregation process. In this way, a toner having a core/shell structure, including a so-called core layer and a shell layer that covers the core layer, can be obtained.

The formation of the coating layer (shell layer) is typically performed by adding an additional resin particle dispersion including resin particles to the dispersion in which the aggregated particles (core particles) are formed in the aggregation process.

The fusing process is performed after the aggregation process, or after the aggregation process and the adhesion process. In the fusing process, the pH of the dispersion including the aggregated particles is regulated so as to stop the aggregation, and then the aggregated particles are fused by heating.

The pH value may be adjusted by adding an acid or an alkali. Although the acid to be used is not specifically limited, an aqueous solution containing an inorganic acid such as hydrochloric acid, nitric acid or sulfuric acid in an amount of from 0.1% by weight to 50% by weight is desirable. Further, although the alkali to be used is not specifically limited, an aqueous solution including a hydroxide of alkali metal such as sodium hydroxide or potassium hydroxide in an amount of from 0.1% by weight to 50% by weight is desirable.

After adjusting the pH value as mentioned above, the aggregated particles are fused (coalesced) by heating the same. The fusing of the aggregated particles is preferably conducted by heating the same to a temperature that is higher than the glass transition temperature of the binder resin by 10° C. to 50° C.

During the heating for fusing or after the completion of fusing, the aggregated particles may be subjected to a crosslinking reaction together with other components. Further, the crosslinking reaction may be performed simultaneously with the fusing. When the crosslinking reaction is performed, a crosslinking agent or a polymerization initiator as mentioned above may be used in the production of the toner.

The polymerization initiator may be mixed in the raw material dispersion during the preparation of the same, or may be mixed in the aggregated particles during the aggregation process. Furthermore, the polymerization initiator may be introduced during the fusing process or after the fusing process. When the polymerization initiator is introduced during the aggregation process, adhesion process or fusing process, or after the fusing process, a solution in which the polymerization initiator is dissolved or emulsified is added to the dispersion. For the purpose of controlling the polymerization degree of the polymerization initiator, a known crosslinking agent, a chain transfer agent or a polymerization inhibitor may be added to the polymerization initiator.

After the fusing process of the aggregated particles is completed, the aggregated particles are subjected to a washing process, a solid-liquid separation process and a drying process, as necessary, whereby the toner particles (toner mother particles) are obtained. In view of chargeability of the obtained toner particles, the washing process is preferably performed by a liquid replacement washing method using ion exchange water. Although the solid-liquid separation process is not specifically restricted, the process is suitably conducted by suction filtration, pressurized filtration or the like, from the viewpoint of productivity. Further, although the drying process is not specifically restricted, the process is suitably conducted by freeze drying, flush jet drying, flow drying, vibro-flow drying or the like, from the viewpoint of productivity. Moreover, an external additive of various kinds as mentioned above may be added to the toner particles (toner mother particles) after being dried, as necessary.

<Carrier>

The carrier used in this exemplary embodiment is a magnetic particle-dispersed carrier including at least a resin and magnetic particles, in which the magnetic particles are dispersed in the resin to form magnetic particle-dispersed resin particles.

The content of each element of Cu, Zn, Ni or Mn (namely, specific metal species) in the carrier is 2,000 ppm or less, respectively.

Examples of the method of controlling the content of the specific metal species to be within the above range include a method of controlling the content of the specific metal species included in the magnetic particles.

The carrier may be in the form of the magnetic particle-dispersed resin particles per se, or may be in the form of a resin coated carrier in which the magnetic particle-dispersed resin particles as a core material are covered with a coating layer.

Hereinafter, details of the resin coated carrier will be described as an example of the magnetic particle-dispersed carrier according to the present exemplary embodiment.

—Core Material—

The core material is formed from magnetic particle-dispersed resin particles obtained by dispersing magnetic particles in a resin.

The material of the magnetic particles is not specifically limited as far as the material is magnetic, and specific examples thereof include magnetic metals such as iron, nickel, cobalt or the like, and magnetic oxides such as ferrite, magnetite or the like.

Among them, from the viewpoint of obtaining a carrier having a magnetism while limiting the content of the specific metal species in the carrier to the above range, a ferrite including elements of Cu, Zn, Ni and Mn is preferred.

The content of the magnetic particles is preferably 80% by weight or more with respect to the total weight of the carrier, in view of suppressing scattering of the carrier.

The volume average particle size of the magnetic particles is preferably from 0.05 μm to 5.0 μm, and is more preferably 0.1 μm to 1.0 μm, in view of improving the degree of magnetization per carrier particle.

The volume average particle size of the magnetic particle may be measured by using a laser diffraction/scattering particle size distribution analyzer. Further, when the magnetic particles are solidified with the resin to form a carrier, the volume average particle size of the magnetic particles may be measured by taking out the magnetic particles from the resin by dissolving the resin with an organic solvent or the like, or by heating and burning the resin portion. Alternatively, the diameter of the carrier may be measured by forming a solid of a curable resin including the carrier and preparing a slice of the solid, and then examining the cross-section of the carrier formed in the slice. In this case, the examination is carried out while gradually whittling away the slice, so as to confirm that the observed cross-section of the magnetic particles is positioned at the center of the same.

The magnetic particles may be produced by applying a mechanical shear force or the like to particles of a desired metal oxide. This method can be performed by a dry method, or by a method of treating the magnetic particles in an aqueous system using a ball mill or the like, and then drying the same after the treatment. Moreover, in order to improve the performance of re-aggregation after pulverization, or improve the wettability with respect to a resinous embedding agent, a coupling agent of various kinds may be used as a surface modification agent. The composition of the core material may be controlled by regulating the amount of the metal oxide powder to be processed, or by regulating the amount of magnetic particles to be mixed in after processing the magnetic particles of each kind individually but before embedding the magnetic particles in the resin. By producing the magnetic particles in this manner, a magnetic particle-dispersed carrier including the elements of specific metal species in an amount as specified above can be obtained.

The resin that forms the core material in which the magnetic particles are dispersed is not specifically restricted, but preferable examples thereof include styrene resins, acrylic resins, phenol resins, melamine resins, epoxy resins, urethane resins, polyester resins and silicone resins. In view of the chargeability, the resin is preferably a curable resin and phenol resins, melamine resins, epoxy resins and urethane resins are preferred.

Further, a crosslinkable resin is preferred from the viewpoint of impact resistance, and a phenol resin is preferred from the viewpoint of heat resistance and acid-base resistance.

The total content of the magnetic particles (including the magnetic particles of other kinds) in the core material is preferably from 80% by weight or about 80% by weight to 99% by weight or about 99% by weight, and is more preferably from 95% by weight to 99% by weight, in view of the degree of magnetization per particle. The ratio of the magnetic particles in the core material can be calculated by dividing the weight of the core material after being burned and carbonized by the weight of the core material in its original state, and then multiplying the quotient by 100.

Furthermore, the core material may include other components, in accordance with the intended purpose, and examples thereof include a charge control agent, fluorine-containing particles, and the like.

The ratio of the magnetic particles in the core material can be calculated from the change in weight as measured using a differential scanning calorimeter (DSC) while increasing the temperature up to 600° C.

Examples of the method of manufacturing the core material include a fusing-and-kneading method including fusing and kneading magnetic particles and a resin that forms a core material in which the magnetic particles are dispersed, using a Banbury mixer or a kneader, and after cooling the resultant, pulverizing and classifying the same (Japanese Patent Publication (JP-B) Nos. 59-24416 and 8-3679); a suspension polymerization method including preparing a suspension by dispersing a monomer unit of a binder resin and magnetic particles in a solvent, and then polymerizing this suspension (JP-A No. 5-100493); and a spray-drying method including mixing and dispersing magnetic particles in a resin solution, and then drying this dispersion by spraying the same.

Each of the above methods includes preparing the magnetic particles beforehand, and then mixing the magnetic particles with a resin solution so that the magnetic particles are dispersed in the resin solution.

The volume average particle size of the core material is preferably from 10 μm to 500 μm, more preferably from 20 μm to 120 μm, still more preferably from 30 μm to 100 μm, and is particularly preferably from 30 μm to 80 μm.

—Coating Layer—

Known matrix resins may be used for a coating layer as far as this material is applicable for a coating layer of a carrier, and two or more kinds of resins may be blended and used. The matrix resins for forming a coating layer are roughly classified into two types of resins, namely, charge-imparting resins that make a toner chargeable, and resins having a low surface energy that prevents migration of a toner component to a carrier.

Examples of the charge-imparting resin that makes a toner negatively chargeable include amino resins such as urea-formaldehyde resin, melamine resin, benzoguanamine resin, urea resin and polyamide resin, epoxy resin, polyvinyl and polyvinylidene resin, acrylic resin, polymethyl methacrylate resin, polystyrene resin such as styrene-acrylate copolymer resin, polyacrylonitrile resin, polyvinyl acetate resin, polyvinyl acetate resin, polyvinyl alcohol resin, polyvinyl butyral resin, and cellulose resin such as ethyl cellulose resin.

Further, examples of the charge-imparting resin that makes a toner positively chargeable include polystyrene resin, halogenated olefin resins such as polyvinyl chloride, polyester resins such as polyethylene terephthalate resin and polybutylene terephthalate resin, and polycarbonate resin.

Examples of the resins having a low surface energy used for preventing migration of a toner component to a carrier include polyethylene resin, polyvinyl fluoride resin, polyvinylidene fluoride resin, polytrifluoroethylene resin, polyhexafluoropropylene resin, a copolymer of vinylidene fluoride and acrylic monomer, a copolymer of vinylidene fluoride and vinyl fluoride, and fluoroterpolymer such as a terpolymer of tetrafluoroethylene, vinylidene fluoride and a non-fluorinated monomer; silicone resin, and the like.

Further, for the purpose of adjusting the resistance, it is desirable to add conductive particles (particles having a volume resistance of $10^5\Omega$ or less, preferably $10^2\Omega$ or less) to the coating layer. In an exemplary embodiment having two or more coating layers, the conductive particles are preferably included at least in the uppermost layer.

Examples of the conductive particles include metal powder, carbon black, titanium oxide, tin oxide, zinc oxide and the like. Among them, carbon black is desirable. These conductive particles preferably have a volume average particle size of 1 μm or less. As necessary, two or more kinds of conductive particles may be used in combination.

The content of the conductive particles in the coating layer (when two or more coating layers are formed, the content of each layer) is preferably from 1% by weight to 50% by weight, and is more preferably from 3% by weight to 20% by weight, from the viewpoint of maintaining the strength of the coating layer and controlling the resistance of the carrier.

Further, the coating layer may include resin particles for the purpose of controlling the chargeability. The resins that form the resin particles include thermoplastic resins and thermosetting resins.

Examples of the thermoplastic resin include polyolefin resins such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymer; styrene-acrylic acid copolymer; straight silicone resins containing organosiloxane bonds or a modified products thereof; fluororesins such as polytetrafluoroethylene, polyvinyl, fluoride, polyvinylidene fluoride or polychlorotrifluoroethylene; polyesters; polycarbonate; and the like.

Examples of the thermosetting resin include phenol resins; amino resins such as urea-formaldehyde resin, melamine resin, benzoguanamine resin, urea resin and polyamide resin; epoxy resins; and the like.

The volume average particle size of the resin particles is preferably from 0.1 μm to 1.5 μm. When the particle size is less than 0.1 μm, dispersibility of the particles is not sufficient and the particles may coalesce in the coating layer. As a result, the exposure rate of a surface of the carrier core material may become unstable, and it may be difficult to maintain the charging characteristics in a stable manner. Moreover, since the film strength of the coating layer decreases at an interface with an aggregate, the coating layer may be easily cracked.

On the other hand, when the particle size of the resin particles exceeds 1.5 μm, the resin particles may be easily detached from the coating layer, and a function of imparting chargeability may not be exhibited. Moreover, the strength of the coating layer may be decreased depending on the particle size.

From the viewpoint of chargeability and resistance, the amount of the coating layer is preferably from 1% by weight to 5% by weight, and is more preferably 1.5% by weight to 3% by weight, with respect to the total weight of the carrier.

The amount of the coating layer can be determined by dissolving the coating resin in a solvent such as toluene, and then calculating a weight ratio of the remaining carrier to the carrier with the coating layer before being dissolved.

The method of forming the coating layer in the carrier is not specifically limited, and conventionally known methods may be applicable.

Examples of the method of forming the coating layer include an immersion method including preparing a solution (coating layer-forming solution) including a matrix resin for forming the coating layer and electroconductive particles (electroconductive powder) or the like in a solvent, and then immersing a core material in the solution; a spray method including spraying a coating layer-forming solution to a surface of a core material; a fluidized-bed method including spraying a coating layer-forming solution to a core material while the core material is suspended by a fluidizing air; and a kneader coater method including mixing a core material with a coating layer-forming solution in a kneader coater, and then removing the solvent.

However, the method of forming a coating layer is not limited to a method using a solvent. For example, depending on the type of core material, a powder application method in which the core material and a resin powder are mixed while heating may be applied. Further, after the formation of coating layer, a heating treatment may be conducted to the resultant using an electric furnace, a kiln or the like.

The solvent used for the coating layer-forming solution as mentioned above is not specifically limited as far as the solvent can dissolve the resin, and examples thereof include aromatic hydrocarbons such as xylene and toluene; ketones such as acetone and methyl ethylketone, ethers such as tetrahydrofuran and dioxane; and halides such as chloroform and carbon tetrachloride.

—Characteristics of Carrier—

As described above, the content of elements of the specific metal species in the carrier is from 0 to 2,000 ppm or less, respectively, preferably from 0 to 1,000 ppm, more preferably from 0 to 200 ppm, still more preferably from 0.1 to 100 ppm, and most preferably from 10 to 50 ppm.

The content of the specific metal species in the carrier can be measured, for example, by using a fluorescent X-ray analyzer.

Further, the total content of elements of all of the specific metal species in the carrier is preferably from 0 ppm to 2,000 ppm, more preferably from 0 ppm to 1,000 ppm, and still more preferably from 0 ppm to 150 ppm.

Moreover, the saturation magnetization of the carrier is preferably 50 emu/g or more, and is more preferably 56 emu/g or more.

One example of the method of measuring the magnetic property uses a vibrating sample magnetometer VSMP10-15 (trade name, manufacture by Toei Industry Co., Ltd.) In this method, the sample is placed in a cell having an inner diameter of 7 mm and a height of 5 mm, and the cell is set in the apparatus. The measurement is conducted by applying a magnetic field and sweeping the same up to a maximum value of 1,000 oersted. Subsequently, the applied magnetic field is decreased and a hysteresis curve is recorded on a recording medium. From the data of the curve, the values of saturation magnetization, residual magnetization and coercivity are obtained. The saturation magnetization refers to a magnetization as measured at a magnetic field of 1,000 oersted.

The mixing ratio (weight ratio) of the yellow toner and the carrier (yellow toner:carrier) in a two-component developer is preferably in the range of from 1:100 to 30:100, and is more preferably in the range of from 3:100 to 20:100. The method of mixing the yellow toner and the carrier is not specifically restricted. For example, the toner and the carrier may be mixed by using a known apparatus such as a V blender, or by other known methods.

<Developer Cartridge, Process Cartridge, Image Formation Apparatus and Image Formation Method>

In the following, a developer cartridge (hereinafter, simply referred to as a "cartridge" sometimes) of the present exemplary embodiment is explained. The cartridge can be removably mounted in an image formation apparatus, and includes a developer to be supplied to a development unit and used for developing an electrostatic latent image formed on the surface of an electrostatic latent image holding unit of the image formation apparatus, thereby forming a toner image. The cartridge of the present exemplary embodiment includes a developer of the present exemplary embodiment as described above.

The image formation apparatus of the present exemplary embodiment includes a latent image holding unit; an electrostatic latent image formation unit that forms an electrostatic latent image on the surface of the latent image holding unit; a development unit that develops the electrostatic latent image with a developer to form a toner image, the developer being the twp-component developer of the present exemplary embodiment; and a transfer unit that transfers the toner image formed on the latent image holding unit to a recording medium.

The structure of the image formation apparatus according to the present exemplary embodiment is not specifically restricted as fax as it includes at least an electrostatic latent image holding unit, an electrostatic latent image formation unit, a development unit and a transfer unit. As necessary, the image formation apparatus may further include a charging unit, a fixing unit, a cleaning unit, a charge removing unit, or the like.

The transfer unit may carry out the transfer process two or more times, with the use of an intermediate transfer unit.

The development unit may employ a trickle development method, and include a developer container that accommodates the developer according to the present exemplary embodiment; a developer supply unit that supplies the developer to the developer container; and a developer discharge unit that discharges at least a part of the developer in the developer container.

In the image formation apparatus, two or more of the above units may operate simultaneously.

The process cartridge according to the present exemplary embodiment is removably attachable to the image formation apparatus, and includes the developer according to the exemplary embodiment and a development unit. As necessary, the process cartridge according to the exemplary embodiment may include other members such as an electrostatic latent image holding unit, a charging unit, a cleaning unit, a charge removing unit, or the like.

The image formation method according to the present exemplary embodiment includes a process of forming an electrostatic latent image on the surface of the latent image holding unit, a process of developing the electrostatic latent image formed on the surface of the latent image holding unit with a developer to form a toner image, and a process of transferring the toner image formed on the surface of the latent image holding unit to the surface of a receiving unit. The developer used in the image formation method according to the present exemplary embodiment is the two-component developer according to the present exemplary embodiment. As necessary, the image formation method according to the present exemplary embodiment may include a charging process, a fixing process, a cleaning process, a charge removing process, or the like.

Each of the above process may be conducted by a known process, and examples thereof include those disclosed in JP-A Nos. 56-40868 and 49-91231. Further, for example, the image formation method according to the present exemplary embodiment may be performed by using a known image formation apparatus such as a copying machine or a facsimile machine.

Hereinafter, specific examples of the image formation apparatus and a process cartridge according to the present exemplary embodiment will be explained with reference to the drawings.

FIG. 1 is a schematic drawing showing an example of the image formation apparatus according to the present exemplary embodiment (a color image formation apparatus employing a four-series tandem system). The image formation apparatus shown in FIG. 1 includes four electrophotographic image formation units 10Y, 10M, 10C and 10K (image formation units) that form an image of yellow (Y), magenta (M), cyan (C) and black (K), respectively, in accordance with the color-separated image data. These image formation units (hereinafter, simply referred as a "unit") 10Y, 10M, 10C and 10K are arranged in a horizontal direction with a space therebetween. These units 10Y, 10M, 10C and 10K may be a process cartridge that is removably attachable to the main body of image formation-apparatus.

In FIG. 1, an intermediate transfer belt 20 that serves as an intermediate transfer unit is positioned so as to extend over units 10Y, 10M, 10C and 10K. Intermediate transfer belt 20 is supported by a drive roller 22 and a support roller 24, with are positioned apart from each other, from the inside of intermediate transfer belt 20, and moves in a direction from the first unit 10Y to the fourth unit 10K. Support roller 24 is urged by a spring or the like (not shown) in a direction away from drive roller 22 so that a tension is applied to intermediate transfer belt 20 supported by these rollers. A cleaning unit 30 is positioned at the image holding unit side of intermediate transfer belt 20, opposite to drive roller 22.

Developers of yellow, magenta, cyan and black are accommodated in developer cartridges 8Y, 8M, 8C and 8K, respectively, and these developers are supplied to development units 4Y, 4M, 4C and 4K included in units 10Y, 10M, 10C and 10K, respectively.

Since units 10Y, 10M, 10C and 10K have substantially the same configuration in this exemplary embodiment, first unit 10Y that forms a yellow image and positioned upstream in a direction in which the intermediate transfer belt move is described below as a representative example. Explanations about second to fourth units 10M, 10C and 10K are omitted by assigning referential marks of magenta (M), cyan (C) or black (K) to a portion equivalent to first unit 10Y, respectively.

First unit 10Y includes a photoreceptor 1Y that functions as an electrostatic latent image holding unit. On the periphery of photoreceptor 1Y, a charging roller (charging unit) 2Y that charges the surface of photoreceptor 1Y, an exposure unit 3 that exposes the charged surface of photoreceptor 1Y to laser beams 3Y in accordance with color-separated image signals and forms an electrostatic latent image, a development unit 4Y that supplies charged toner to the electrostatic image and develops the electrostatic image with the toner, a primary transfer roller 5Y (primary transfer unit) that transfers the developed toner image onto the intermediate transfer belt 20, and a cleaning unit 6Y that removes the toner remaining on the surface of photoreceptor 1Y after the primary transfer, are arranged in this order.

In addition, a primary transfer roller 5Y is arranged inside the intermediate transfer belt 20, at a position opposite to photoreceptor 1Y. The primary transfer roller 5Y is connected to a bias power source (not shown) that applies a primary transfer bias thereto. The bias power source is controlled by a control unit (not shown) that can change the transfer bias applied to the primary transfer roller.

Hereinafter, the operation of forming a yellow image of the first unit 10Y is explained. First, prior to the operation, the surface of the photoreceptor 1Y is charged with the charging roller 2Y to have an electric potential of about −800V to −600V.

The photoreceptor 1Y includes a photosensitive layer formed on a substrate having conductivity (volume resistivity at 20° C.: $1\times10^{-6}$ Ωcm or less). This photosensitive layer has a high degree of resistance (i.e., a resistance equivalent of that of a resin of ordinary type) in its ordinary state. However, the photosensitive layer has such a characteristic that a value of specific resistance changes at a portion irradiated with laser beam 3Y. Accordingly, when the surface of charged photoreceptor 1Y is irradiated with laser beam 3Y from an exposure device 3 in accordance with image data for a yellow image sent from a control section (not shown), an electrostatic image having a yellow print pattern is formed on the surface of photoreceptor 1Y.

The electrostatic image is an image formed on the surface of photoreceptor 1Y by charging the same. Specifically, the specific resistance of the photosensitive layer of the photoreceptor at a portion irradiated with laser beam 3Y is lowered and the charges at this portion are allowed to flow, while the charges at a portion not irradiated with the laser beam remain the same. As a result, a so-called negative latent image is formed.

The electrostatic image formed on the photoreceptor 1Y is moved to a development position along with the movement of photoreceptor 1Y, and at this development position, the electrostatic charged image on photoreceptor 1Y is formed into a visible image (developed image) with developing unit 4Y.

In development unit 4Y, for example, a yellow toner including a yellow colorant and a binder resin, and a carrier are accommodated. The yellow toner is agitated in development unit 4Y so as to be triboelectrically charged to have the same polarity as that of the charges on photoreceptor 1Y, and is placed on a developer roller (developer holding unit). When the surface of photoreceptor 1Y passes development unit 4Y, the yellow toner is electrostatically attached to the discharged latent image formed on the surface of photoreceptor 1Y, and the latent image is developed with the yellow toner. Then, photoreceptor 1Y on which the yellow toner image is formed continues to move to convey the toner image formed on photoreceptor 1Y to a primary transfer position.

When the yellow toner image on photoreceptor 1Y is conveyed to the primary transfer position, a primary transfer bias is applied to the primary transfer roller 5Y, and an electrostatic force in a direction of from photoreceptor 1Y to primary transfer roller 5Y acts on the toner image. Then, the toner image formed on photoreceptor 1Y is transferred to intermediate transfer belt 20. The transfer bias applied at this time has the polarity (+) that is opposite to the polarity (−) of the toner, and is controlled to a degree of about +10 μA by a control unit (not shown) in first unit 10Y, for example.

On the other hand, the toner remaining on photoreceptor 1Y is removed and recovered by a cleaning device 6Y.

The primary transfer bias applied to each of primary transfer rollers 5M, 5C and 5K in units 10M, 10C and 10K is also controlled in a similar manner to first unit 10Y Intermediate transfer belt 20 to which a yellow toner image has been transferred in first unit 10Y moves to pass second to fourth units 10M, 10C and 10K, at which a toner image of each color is sequentially transferred so as to overlap each other.

Then, intermediate transfer belt 20 on which the toner image formed of overlapping toner images of four colors has been transferred moves to a secondary transfer section. The secondary transfer section includes intermediate transfer belt 20, support roller 24 that contacts the inner surface of intermediate transfer belt 20, and a secondary transfer roller (secondary transfer unit) 26 positioned at the image holding side of intermediate transfer belt 20. On the other hand, a recording medium P is supplied by a supply system to a portion at which secondary transfer roller 26 and intermediate transfer belt 20 contact each other with pressure, and a secondary transfer bias is applied to support roller 24. At this time, the polarity (−) of the transfer bias to be applied is the same as the polarity (−) of the toner, and an electrostatic force in a direction from intermediate transfer belt 20 toward recording medium P acts on the toner image. As a result, the toner image formed on intermediate transfer belt 20 is transferred to recording medium P. At this time, the secondary transfer bias is determined in accordance with the resistance detected by a resistance detection unit (not shown) that detects the resistance at the secondary transfer section, and is controlled by a voltage.

Thereafter, recording medium P is conveyed to a fixing device (fixing unit) 28, and the overlapping toner images are heated and fused so as to fix to recording medium, P. After the fixation of the color image, recording medium P is conveyed to a discharge section and discharged, thereby completing the color image formation operation.

Although the image formation apparatus as illustrated in the above transfers a toner image to recording medium P using intermediate transfer belt 20, the image formation apparatus may transfer a toner image to recording medium P directly from the photoreceptor.

Figure 2:
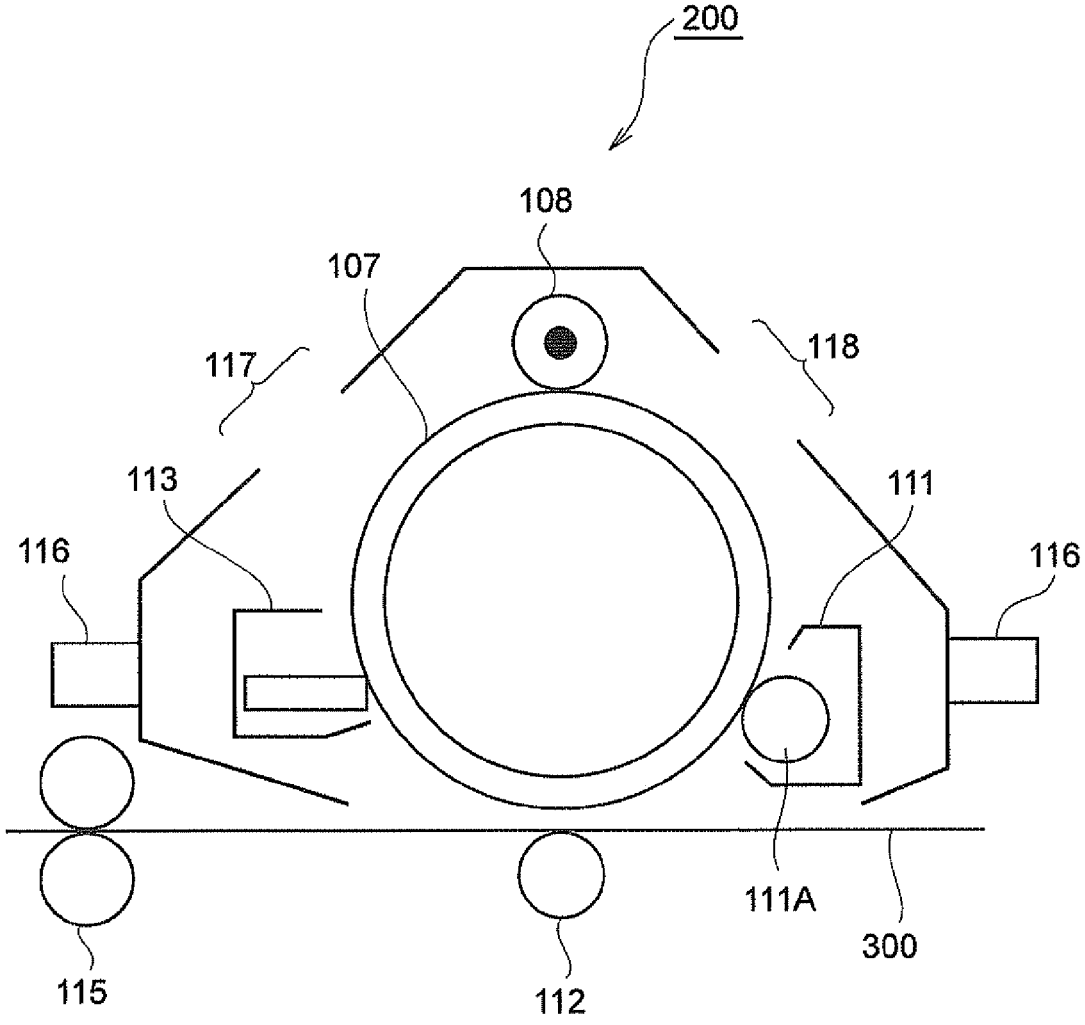
FIG. 2 is a schematic drawing showing an example of a process cartridge according to the invention.

FIG. 2 is a schematic structural drawing showing an exemplary embodiment of a process cartridge which accommodates the developer for electrostatic charge development of the present exemplary embodiment. The process cartridge 200 includes a photoreceptor (electrostatic latent image holding unit) 107, a charging roller (charging unit) 108, a development device (development unit) 111 including a developer holding unit 111A, a photoreceptor cleaning device (cleaning unit) 113, an opening 118 for performing exposure, and an opening 117 for performing charge-removing exposure, which are integrally assembled by means of a rail 116.

The process cartridge 200 may be removably mounted to the main body of image formation apparatus including a transfer device (transfer unit) 112, a fixing device (fixing unit) 115 and other components (not shown). The object indicated by 300 is a recording medium.

The combination of the components included in the process cartridge as shown in FIG. 2 may be appropriately selected, as long as developing device 111 is included in the process cartridge.

EXAMPLES

Hereinafter, the invention will be described in detail with reference to the Examples, but the invention is not limited thereto. In the Examples, "part" and "%" each refer to "part by weight" and "% by weight", unless otherwise specified.

Measuring Method of Physical Properties

First, the methods of measuring the physical properties of the developer or the like as prepared in the Examples and the Comparative Examples are explained.

<Measurement of Melting Point and Glass Transition Temperature>

The melting point and the glass transition temperature are measured by heating 10 mg of a sample at a constant rate of 10° C./minute, using a differential scanning calorimeter (DSC-20, trade name, manufactured by Seiko Instruments, Inc.)

The melting point of a crystalline resin is determined as a melting peak temperature as measured by an input compensation-type differential scanning calorimetric method as specified in JIS K-7121:87, using a differential scanning calorimeter (DSC) while increasing the temperature from room temperature (25° C.) to 150° C. at a rate of 10° C./minute.

When the crystalline resin exhibits two or more melting peaks, the maximum peak is regarded as the melting point.

The glass transition temperature of a non-crystalline resin is measured by a method as specified in ASTM D3418-82 (DSC method).

<Measurement of Weight Average Molecular Weight (Mw) and Number Average Molecular Weight (Mn)>

The molecular weight distribution of the toner is measured by gel permeation chromatography (GPC), using an apparatus HLC-8120GPC, SC-8020 (trade name, manufactured by Tosoh Corporation), two columns of TSKgel, Super HM-H (trade name, manufactured by Tosoh Corporation, 6.0 mm ID×15 cm), and THF (tetrahydrofuran) as an eluent. The measurement is conducted at a sample concentration of 0.5%, a flow rate of 0.6 ml/min, a sample injection amount of 10 μl, a measurement temperature of 40° C., using an IR detector.

The calibration curves are obtained from ten samples (polystyrene reference samples TSK Standard, A-500, F-1, F-10, F-80, F-380, A-2500, F-4, F-40, F-128 and F-700, manufactured by Tosoh Corporation).

<Measurement of Average Particle Size>

The volume average particle size is measured using a particle size analyzer (COULTER MULTISIZER II, trade name, manufactured by Beckman Coulter, Inc.) with an aperture size of 50 μm. In the following, the particle size as measured is a volume average particle size, unless otherwise specified.

In the measurement, a measurement sample is added to an aqueous solution including a surfactant as a dispersant. Specifically, 1.0 mg of a measurement sample is added to 2 ml of a 5% aqueous solution of sodium alkylbenzene sulfonate. This mixture is added to 100 ml of an electrolytic solution (ISOTON, trade name, manufactured by Beckman Coulter, Inc.), and an electrolytic solution in which the sample is suspended is obtained.

The electrolytic solution in which the sample is suspended is subjected to a dispersion process for one minute using an ultrasonic wave dispersion apparatus. Then, the particle size distribution of the particles having a diameter of from 1 μm to 30 μm is measured by the COULTER MULTISIZER II with an aperture diameter of 50 μm, and the volume average particle size and the number average particle size are obtained therefrom. The number of particles to be measured is 50,000.

When the particles to be measured have a diameter of less than 2 μm, the diameter is measured by a laser diffraction particle size distribution analyzer (LA-700, trade name, manufactured by Horiba, Ltd.) In this process, a sample in the form of a dispersion is adjusted so that the solid content is 2 g, and ion exchanged water is added thereto to make the total amount to 40 ml. This mixture is placed in a cell to give an appropriate concentration. Two minutes after, when the concentration in the cell is substantially stable, the measurement is conducted.

The volume average particle size obtained at each channel is accumulated in ascending order (from the smaller volume average particle size to the larger volume average particle size), and the value at an accumulation of 50% is defined as the volume average particle size.

In addition, when the particle size of a powder such as an external additive is measured, 2 g of a measurement sample is added to 50 ml of a 5% aqueous solution of sodium alkylbenzene sulfonate and this mixture is dispersed for two minutes using an ultrasonic dispersing apparatus (1,000 Hz) to prepare a sample, and then the measurement of this sample is conducted in a similar manner to the above dispersion.

<Content of Cu Element, Zn Element, Ni Element and Mn Element in Carrier>

The content of each element of Cu, Zn, Ni and Mn is measured using a fluorescent X-ray analyzer (ASF-40, trade name, manufactured by Shimadzu Corporation).

Preparation of Carrier

<Preparation of Carrier 1>

—Magnetic Particles 1—

10,000 parts of iron oxide ($Fe_3O_4$), 1,700 parts of calcium oxide (CaO), 840 parts of magnesium oxide (MgO), 0.2 parts of copper oxide (CuO), 0.25 parts of zinc oxide (ZnO), 0.25 parts of nickel oxide (NiO) and 0.25 parts of manganese oxide (MgO) are weighed and pulverized for 5 hours in an aqueous medium using a ball mill to obtain a mixture. After drying the mixture with a spray drier, 3.0 parts of a titanate coupling agent (PLAINACT TTS, trade name, manufactured by Ajinomoto Co., Inc.) is added thereto. Then, the temperature is raised to about 100° C. and the mixture is sufficiently mixed by stirring for about 40 minutes, thereby obtaining magnetic particles 1 covered with the titanate coupling agent.

—Preparation of Carrier 1 (Core)—

50 parts of phenol, 70 parts of 40% formalin, 500 parts of the lipophilicized magnetic particles 1 as prepared above, 17 parts of 30% aqueous ammonia and 75 parts of water are placed in a 1-liter flask, and the temperature of this mixture is gradually raised to 85° C. over 30 minutes while mixing the same by stirring. The mixture is then allowed to react for 180 minutes to cure, thereby obtaining core material particles having a spherical shape. After cooling the spherical core particles to about 50° C., 6 parts of urea, 20 parts of formalin, 12 parts of ammonium chloride and 100 parts of water are added thereto, and the temperature is raised to 85° C. over 30 minutes and allowed to react for 60 minutes, thereby forming a resin coating layer on the spherical core material particles. The mixture is cooled to 30° C. and the supernatant liquid is removed, and the precipitate formed at the bottom is washed and air-dried. The resultant is dried at 180° C. under reduced pressure, and a carrier 1 having a resin coating layer formed thereon is obtained. The ratio of the resin in carrier 1 is 18%.

The contents of the specific metal species as measured by a fluorescent X-ray measurement are shown in Table 1.

<Preparation of Carrier 2>

Carrier 2 is prepared in a manner similar to the preparation of carrier 1, except that the amount of copper oxide is changed to 0.9 parts.

The content of the specific metal species in the carrier as measured by a fluorescent X-ray measurement is shown in Table 1.

<Preparation of Carrier 3>

Carrier 3 is prepared in a manner similar to the preparation of carrier 1, except that the amount of zinc oxide is changed to 0.9 parts.

The content of the specific metal species in the carrier as measured by a fluorescent X-ray measurement is shown in Table 1.

<Preparation of Carrier 4>

Carrier 4 is prepared in a manner similar to the preparation of carrier 1, except that the amount of nickel oxide is changed to 0.9 parts.

The content of the specific metal species in the carrier as measured by a fluorescent X-ray measurement is shown in Table 1.

<Preparation of Carrier 5>

Carrier 5 is prepared in a manner similar to the preparation of carrier 1, except that the amount of manganese oxide is changed to 0.9 parts.

The content of the specific metal species in the carrier as measured by a fluorescent X-ray measurement is, shown in Table 1.

<Preparation of Carrier 6>

Carrier 6 is prepared in a manner similar to the preparation of carrier 1, except that the amount of copper oxide is changed to 1.0 part.

The content of the specific metal species in the carrier as measured by a fluorescent X-ray measurement is shown in Table 1.

<Preparation of Carrier 7>

Carrier 7 is prepared in a manner similar to the preparation of carrier 1, except that the amount of zinc oxide is changed to 1.0 part.

The content of the specific metal species in the carrier as measured by a fluorescent X-ray measurement is shown in Table 1.

<Preparation of Carrier 8>

Carrier 8 is prepared in a manner similar to the preparation of carrier 1, except that the amount of nickel oxide is changed to 1.0 part.

The content of the specific metal species in the carrier as measured by a fluorescent X-ray measurement is shown in Table 1.

<Preparation of Carrier 9>

Carrier 9 is prepared in a manner similar to the preparation of carrier 1, except that the amount of manganese oxide is changed to 1.1 parts.

The content of the specific metal species in the carrier as measured by a fluorescent X-ray measurement is shown in Table 1.

<Preparation of Carrier 10>

Carrier 10 is prepared in a manner similar to the preparation of carrier 1, except that the amount of copper oxide is changed to 1.8 parts.

The content of the specific metal species in the carrier as measured by a fluorescent X-ray measurement is shown in Table 1.

<Preparation of Carrier 11>

Carrier 11, is prepared in a manner similar to the preparation of carrier 1, except that the amount of zinc oxide is changed to 1.8 parts.

The content of the specific metal species in the carrier as measured by a fluorescent X-ray measurement is shown in Table 1.

<Preparation of Carrier 12>

Carrier 12 is prepared in a manner similar to the preparation of carrier 1, except that the amount of nickel oxide is changed to 1.8 parts.

The content of the specific metal species in the carrier as measured by a fluorescent X-ray measurement is shown, in Table 1.

<Preparation of Carrier 13>

Carrier 13 is prepared in a manner similar to the preparation of carrier 1, except that the amount of manganese oxide is changed to 1.9 parts.

The content of the specific metal species in the carrier as measured by a fluorescent X-ray measurement is shown in Table 1.

<Preparation of Carrier 14>

Carrier 14 is prepared in a manner similar to the preparation of carrier 1, except that the amount of copper oxide is changed to 2.0 parts.

The content of the specific metal species in the carrier as measured by a fluorescent X-ray measurement is shown in Table 1.

<Preparation of Carrier 15>

Carrier 15 is prepared in a manner similar to the preparation of carrier 1, except that the amount of zinc oxide is changed to 2.0 parts.

The content of the specific metal species in the carrier as measured by a fluorescent X-ray measurement is shown in Table 1.

<Preparation of Carrier 16>

Carrier 16 is prepared in a manner similar to the preparation of carrier 1, except that the amount of nickel oxide is changed to 2.0 parts.

The content of the specific metal species in the carrier as measured by a fluorescent X-ray measurement is shown in Table 1.

<Preparation of Carrier 17>

Carrier 17 is prepared in a manner similar to the preparation of carrier 1, except that the amount of manganese oxide is changed to 2.1 parts.

The content of the specific metal species in the carrier as measured by a fluorescent X-ray measurement is shown in Table 1.

<Preparation of Carrier 18>

Carrier 18 is prepared in a manner similar to the preparation of carrier 1, except that the amount of copper oxide is changed to 3.7 parts.

The content of the specific metal species in the carrier as measured by a fluorescent X-ray measurement is shown in Table 1.

<Preparation of Carrier 19>

Carrier 19 is prepared in a manner similar to the preparation of carrier 1, except that the amount of zinc oxide is changed to 3.7 parts.

The content of the specific metal species in the carrier as measured by a fluorescent X-ray measurement is shown in Table 1.

<Preparation of Carrier 20>

Carrier 20 is prepared in a manner similar to the preparation of carrier 1, except that the amount of nickel oxide is changed to 3.8 parts.

The content of the specific metal species in the carrier as measured by a fluorescent X-ray measurement is shown in Table 1.

<Preparation of Carrier 21>

Carrier 21 is prepared in a manner similar to the preparation of carrier 1, except that the amount of manganese oxide is changed to 3.8 parts.

The content of the specific metal species in the carrier as measured by a fluorescent X-ray measurement is shown in Table 1.

<Preparation of Carrier 22>

Carrier 22 is prepared in a manner similar to the preparation of carrier 1, except that the amount of copper oxide is changed to 4.0 parts.

The content of the specific metal species in the carrier as measured by a fluorescent X-ray measurement is shown in Table 1.

<Preparation of Carrier 23>

Carrier 23 is prepared in a manner similar to the preparation of carrier 1, except that the amount of zinc oxide is changed to 4.0 parts.

The content of the specific metal species in the carrier as measured by a fluorescent X-ray measurement is shown in Table 1.

<Preparation of Carrier 24>

Carrier 24 is prepared in a manner similar to the preparation of carrier 1, except that the amount of nickel oxide is changed to 4.0 parts.

The content of the specific metal species in the carrier as measured by a fluorescent X-ray measurement is shown in Table 1.

<Preparation of Carrier 25>

Carrier 25 is prepared in a manner similar to the preparation of carrier 1, except that the amount of manganese oxide is changed to 4.1 parts.

The content of the specific metal species in the carrier as measured by a fluorescent X-ray measurement is shown in Table 2.

<Preparation of Carrier 26>

Carrier 26 is prepared in a manner similar to the preparation of carrier 1, except that the amount of copper oxide is changed to 19 parts.

The content of the specific metal species in the carrier as measured by a fluorescent X-ray measurement is shown in Table 2.

<Preparation of Carrier 27>

Carrier 27 is prepared in a manner similar to the preparation of carrier 1, except that the amount of zinc oxide is changed to 18 parts.

The content of the specific metal species in the carrier as measured by a fluorescent X-ray measurement is shown in Table 2.

<Preparation of Carrier 28>

Carrier 28 is prepared in a manner similar to the preparation of carrier 1, except that the amount of nickel oxide is changed to 19 parts.

The content of the specific metal species in the carrier as measured by a fluorescent X-ray measurement is shown in Table 2.

<Preparation of Carrier 29>

Carrier 29 is prepared in a manner similar to the preparation of carrier 1, except that the amount of manganese oxide is changed to 18 parts.

The content of the specific metal species in the carrier as measured by a fluorescent X-ray measurement is shown in Table 2.

<Preparation of Carrier 30>

Carrier 30 is prepared in a manner similar to the preparation of carrier 1, except that the amount of copper oxide is changed to 20 parts.

The content of the specific metal species in the carrier as measured by a fluorescent X-ray measurement is shown in Table 2.

<Preparation of Carrier 31>

Carrier 31 is prepared in a manner similar to the preparation of carrier 1, except that the amount of zinc oxide is changed to 20 parts.

The content of the specific metal species in the carrier as measured by a fluorescent X-ray measurement is shown in Table 2.

<Preparation of Carrier 32>

Carrier 32 is prepared in a manner similar to the preparation of carrier 1, except that the amount of nickel oxide is changed to 20 parts.

The content of the specific metal species in the carrier as measured by a fluorescent X-ray measurement is shown in Table 2.

<Preparation of Carrier 33>

Carrier 33 is prepared in a manner similar to the preparation of carrier 1, except that the amount of manganese oxide is changed to 21 parts.

The content of the specific metal species in the carrier as measured by a fluorescent X-ray measurement is shown in Table 2.

<Preparation of Carrier 34>

Carrier 34 is prepared in a manner similar to the preparation of carrier 1, except that the amount of copper oxide is changed to 38 parts.

The content of the specific metal species in the carrier as measured by a fluorescent X-ray measurement is shown in Table 2.

<Preparation of Carrier 35>

Carrier 35 is prepared in a manner similar to the preparation of carrier 1, except that the amount of zinc oxide is changed to 37 parts.

The content of the specific metal species in the carrier as measured by a fluorescent X-ray measurement is shown in Table 2.

<Preparation of Carrier 36>

Carrier 36 is prepared in a manner similar to the preparation of carrier 1, except that the amount of nickel oxide is changed to 38 parts.

The content of the specific metal species in the carrier as measured by a fluorescent X-ray measurement is shown in Table 2.

<Preparation of Carrier 37>

Carrier 37 is prepared in a manner similar to the preparation of carrier 1, except that the amount of manganese oxide is changed to 39 parts.

The content of the specific metal species in the carrier as measured by a fluorescent X-ray measurement is shown in Table 2.

<Preparation of Carrier 38>

Carrier 38 is prepared in a manner similar to the preparation of carrier 1, except that the amount of copper oxide is changed to 39 parts.

The content of the specific metal species in the carrier as measured by a fluorescent X-ray measurement is shown in Table 2.

<Preparation of Carrier 39>

Carrier 39 is prepared in a manner similar to the preparation of carrier 1, except that the amount of zinc oxide is changed to 39 parts.

The content of the specific metal species in the carrier as measured by a fluorescent X-ray measurement is shown in Table 2.

<Preparation of Carrier 40>

Carrier 40 is prepared in a manner similar to the preparation of carrier 1, except that the amount of nickel oxide is changed to 40 parts.

The content of the specific metal species in the carrier as measured by a fluorescent X-ray measurement is shown in Table 2.

<Preparation of Carrier 41>

Carrier 41 is prepared in a manner similar to the preparation of carrier 1, except that the amount of manganese oxide is changed to 40 parts.

The content of the specific metal species in the carrier as measured by a fluorescent X-ray measurement is shown in Table 2.

TABLE 1

| | Cu Element Content (ppm) | Zn Element Content (ppm) | Ni Element Content (ppm) | Mn Element Content (ppm) | Specific Metal Species Element Content (ppm) |
|---|---|---|---|---|---|
| Carrier 1 | 10 | 13 | 13 | 13 | 49 |
| Carrier 2 | 47 | 13 | 13 | 13 | 86 |
| Carrier 3 | 10 | 47 | 13 | 13 | 83 |
| Carrier 4 | 10 | 13 | 46 | 13 | 82 |
| Carrier 5 | 10 | 13 | 13 | 46 | 82 |
| Carrier 6 | 52 | 13 | 13 | 13 | 91 |
| Carrier 7 | 10 | 53 | 13 | 13 | 89 |
| Carrier 8 | 10 | 13 | 51 | 13 | 87 |
| Carrier 9 | 10 | 13 | 13 | 56 | 92 |

TABLE 1-continued

| | Cu Element Content (ppm) | Zn Element Content (ppm) | Ni Element Content (ppm) | Mn Element Content (ppm) | Specific Metal Species Element Content (ppm) |
|---|---|---|---|---|---|
| Carrier 10 | 94 | 13 | 13 | 13 | 133 |
| Carrier 11 | 10 | 95 | 13 | 13 | 131 |
| Carrier 12 | 10 | 13 | 92 | 13 | 128 |
| Carrier 13 | 10 | 13 | 13 | 96 | 132 |
| Carrier 14 | 104 | 13 | 13 | 13 | 143 |
| Carrier 15 | 10 | 105 | 13 | 13 | 141 |
| Carrier 16 | 10 | 13 | 103 | 13 | 139 |
| Carrier 17 | 10 | 13 | 13 | 106 | 142 |
| Carrier 18 | 193 | 13 | 33 | 13 | 232 |
| Carrier 19 | 10 | 195 | 13 | 13 | 231 |
| Carrier 20 | 10 | 13 | 195 | 13 | 231 |
| Carrier 21 | 10 | 13 | 13 | 192 | 228 |
| Carrier 22 | 209 | 13 | 13 | 13 | 248 |
| Carrier 23 | 10 | 211 | 13 | 13 | 247 |
| Carrier 24 | 10 | 13 | 205 | 13 | 241 |

TABLE 2

| | Cu Element Content (ppm) | Zn Element Content (ppm) | Ni Element Content (ppm) | Mn Element Content (ppm) | Specific Metal Species Element Content (ppm) |
|---|---|---|---|---|---|
| Carrier 25 | 10 | 13 | 13 | 208 | 244 |
| Carrier 26 | 991 | 13 | 13 | 13 | 1030 |
| Carrier 27 | 10 | 947 | 13 | 13 | 983 |
| Carrier 28 | 10 | 13 | 975 | 13 | 1011 |
| Carrier 29 | 10 | 13 | 13 | 910 | 946 |
| Carrier 30 | 1043 | 13 | 13 | 13 | 1082 |
| Carrier 31 | 10 | 1052 | 13 | 13 | 1088 |
| Carrier 32 | 10 | 13 | 1026 | 13 | 1062 |
| Carrier 33 | 10 | 13 | 13 | 1061 | 1097 |
| Carrier 34 | 1978 | 13 | 13 | 13 | 2017 |
| Carrier 35 | 10 | 1943 | 13 | 13 | 1979 |
| Carrier 36 | 10 | 13 | 1946 | 13 | 1982 |
| Carrier 37 | 10 | 13 | 13 | 1968 | 2004 |
| Carrier 38 | 2030 | 13 | 13 | 13 | 2069 |
| Carrier 39 | 10 | 2048 | 13 | 13 | 2084 |
| Carrier 40 | 10 | 13 | 2048 | 13 | 2084 |
| Carrier 41 | 10 | 13 | 13 | 2019 | 2055 |

Preparation of Toner

<Preparation of Dispersions>

—Preparation of Resin Particle Dispersion 1—

| | |
|---|---|
| Bisphenol A (2 mole ethylene oxide adduct): | 40% by mole; |
| 1,2-propanediol: | 10% by mole; |
| Terephthalic acid: | 30% by mole; |
| Adipic acid: | 20% by mole. |

The monomers of the above composition ratio are placed in a flask equipped with a stirrer, a nitrogen introduction pipe, a temperature sensor and a distillation column, and the temperature of the monomer composition is raised to 190° C. over one hour. After confirming that the reaction system is uniformly agitated, 0.5% by weight of dibutyl tin oxide is added to the reaction system. The temperature of the reaction system is raised from 190° C. to 240° C. over 6 hours while distilling away water generated during this process, and the dehydration condensation reaction is allowed to continue at 240° C. for another two hours. Polyester resin 1 having a glass transition temperature of 57° C. and a weight average molecular weight of 28,500 is thus obtained.

The amount of addition of ethylene oxide to bisphenol A means the amount of ethylene oxide added to one hydroxyl group. In the compound, ethylene oxide is added to all of the hydroxyl groups.

A mixed solvent of ethyl acetate and isopropyl alcohol in an amount enough to dissolve the polyester resin as prepared above is placed in a separable flask, and the polyester resin is slowly added to the mixed solvent. The mixture is stirred with a three-one motor to dissolve the polyester resin to the mixed solvent, thereby obtaining an oil phase. While stirring this oil phase, a moderate amount of a dilute aqueous ammonia solution is dropped thereto, and the oil phase is dropped in ion exchange water to cause phase inversion emulsification. Further, the solvent is removed from the reaction system under reduced pressure using an evaporator, and resin particle dispersion 1 is obtained. The volume average particle size of the resin particles in the dispersion is 0.13 μm (the concentration of the resin particles is adjusted to 30% by weight with ion exchange water).

—Preparation of Resin Particle Dispersion 2—

| | |
|---|---|
| Styrene (manufactured by Wako Pure Chemical Industries, Ltd.): | 340 parts by weight |
| n-butyl acrylate (manufactured by Wako Pure Chemical Industries, Ltd.): | 60 parts by weight |
| β-carboxyethyl acrylate (manufactured by Rhodia Nicca Chemical Co., Ltd.): | 7 parts by weight |
| 1,10-decanediol diacrylate (manufactured by Shin-Nakamura Chemical Co., Ltd.): | 1.1 parts by weight |
| Dodecanethiol (manufactured by Kao Corporation): | 2.8 parts by weight. |

The above materials are mixed to dissolve with each other. This mixture is added to a liquid prepared by dissolving 4 parts by weight of an anionic surfactant (DOWFAX, trade name, manufactured by Dow Chemical Company) in 550 parts by weight of ion exchange water in a flask, and the mixture is dispersed and emulsified while mechanically stirring. Then, 50 parts by weight of ion exchange water in which 6 parts by weight of ammonium persulfate is dissolved is added to the mixture while slowly stirring the same over 10 minutes. Subsequently, the system is thoroughly replaced with a nitrogen gas, and then the flask is heated using an oil bath to 70° C. while stirring to allow the emulsification polymerization to continue for 5 hours. A resin particle dispersion 2 is thus obtained (volume average particle size of dispersed particles: 200 nm, glass transition temperature: 51.0° C., weight average molecular weight (Mw): 27,000, solid content: diluted to 20% by weight with ion exchange water).

—Preparation of Yellow Colorant Particle Dispersion Y1—

20 parts by weight of C. I. Pigment Yellow 185 (PY 185, manufactured by BASF SE)) as a yellow pigment, 2 parts by weight of an anionic surfactant (active ingredient of NEOGEN SC, trade name, manufactured by Daiichi Kogyo Seiyaku Co., Ltd.), 58 parts by weight of ion exchange water are mixed and dispersed using a homogenizer (ULTRATRAX T50, trade name, manufactured by IKA-Werke GMBH & Co., KG) at 6,000 rpm for 5 minutes, and then the resultant is stirred for a full day with a stirrer for defoaming. Subsequently, the dispersion is further dispersed at a pressure of 240 MPa using a high-pressure collision-type dispersing machine (ALTIMIZER HJP30006, trade name, manufactured by Sugino Machine Limited). This dispersion process is performed for an equivalent of 25 paths. A yellow colorant particle dispersion Y1 is thus obtained. The volume average particle size of the colorant particles in the colorant particle dispersion at a solid concentration of 25% by weight is 0.15 μm.

—Preparation of Yellow Colorant Particle Dispersion Y2—

Yellow colorant particle dispersion Y2 is prepared in a manner similar to yellow colorant particle dispersion Y1, except that the yellow pigment is changed to C. I. Pigment Yellow 74 (PY 74, SEIKA FAST YELLOW 2054, trade name, manufactured by Dainichiseika Color & Chemicals Mfg. Co., Ltd.) The volume average particle size of the colorant particles in the colorant particle dispersion at a solid concentration of 25% by weight is 0.13 μm.

—Preparation of Yellow Colorant Particle Dispersion Y3—

Yellow colorant particle dispersion Y3 is prepared in a manner similar to yellow colorant particle dispersion Y1, except that the yellow pigment is changed to C. I. Pigment Yellow 155 (PY 155, manufactured by BASF SE). The volume average particle size of the colorant particles in the colorant particle dispersion at a solid concentration of 25% by weight is 0.19 μm.

—Preparation of Yellow Colorant Particle Dispersion Y4—

Yellow colorant particle dispersion Y4 is prepared in a manner similar to yellow colorant particle dispersion Y1, except that the yellow pigment is changed to C. I. Pigment Yellow 93 (PY 93, CHROMOFINE YELLOW 5930, trade name, manufactured by Dainichiseika Color & Chemicals Mfg. Co., Ltd.) The volume average particle size of the colorant particles in the colorant particle dispersion at a solid concentration of 25% by weight is 0.18 μm.

—Preparation of Cyan Colorant Particle Dispersion C1—

Cyan colorant particle dispersion C1 is prepared in a manner similar to yellow colorant particle dispersion Y1, except that the yellow pigment is changed to a cyan pigment (PIGMENT BLUE, trade name, PB15-3, manufactured by Dainichiseika Color & Chemicals Mfg. Co., Ltd.) The volume average particle size of the colorant particles in the colorant particle dispersion at a solid concentration of 25% by weight is 0.15 μm.

—Preparation of Release agent Particle Dispersion—

40 parts by weight of carnauba wax (melting point: 81° C.), 2 parts by weight of an anionic surfactant ((NEOGEN SC, trade name, manufactured by Daiichi Kogyo Seiyaku Co., Ltd.) and 58 parts by weight of ion exchange water are mixed and dispersed using a homogenizer (ULTRA-TURRAX, (trade name) manufactured by IKA-Werke GMBH & Co., KG) at 6,000 rpm for 5 minutes. Then, the dispersion is stirred for a full day with a stirrer for defoaming. Subsequently, the dispersion is further subjected to a dispersion process using a high-pressure ejection-type Gaulin homogenizer. Thereafter, the solid concentration of the dispersion is adjusted to 25% by weight by adding ion exchange water. The volume average particle size of the release agent particle dispersion is 0.23 μm.

<Preparation of Toner>

—Preparation of Yellow Toner Y1—

| | |
|---|---|
| Ion exchange water: | 360 parts by weight |
| Resin particle dispersion 1: | 190 parts by weight |
| Anionic surfactant ((NEOGEN RK, trade name, 20% by weight): | 2 parts by weight |

The above components are placed in a reaction vessel equipped with a thermometer, a pH meter and a stirrer, and are maintained at a temperature of 30° C. for 30 minutes while stirring at 150 rpm. The temperature is controlled from outside with a mantle heater. Thereafter, 24 parts by weight of yellow colorant dispersion Y1, 4 parts by weight of yellow colorant dispersion Y2 and 40 parts by weight of the release agent dispersion are placed in the reaction vessel, and are maintained for 5 minutes. Then, a 1.0% by weight aqueous solution of nitric acid is added thereto to adjust the pH value to 4.0. An aqueous solution prepared by dissolving 0.15 parts by weight of polyaluminum chloride, 0.04 parts of magnesium chloride and 0.04 parts of calcium chloride in 10 parts by weight of water is added to this mixture while dispersing the same using a homogenizer (ULTRA-TURRAX T50, trade name, manufactured by IKA-Werke GMBH & Co., KG) over 5 minutes, and then the temperature of the mixture is raised to 50° C. When the volume average particle size reaches 5.4 μm, 96 parts by weight of resin particle dispersion 1 is added to the mixture and the resultant is left to stand for 30 minutes. Then, the pH value is adjusted to 9.0 with a 5% by weight aqueous solution of sodium hydroxide. Thereafter, the temperature of the mixture is raised and maintained at 90° C. for three hours, and the mixture is cooled and filtered, and then further re-dispersed in ion exchange water and filtered. The filtered residue is washed for several times until the filtrate has an electroconductivity of 20 μS/cm or less, and the resulting residue is vacuum-dried in an oven at 40° C. for four hours to obtain yellow toner particles Y1.

1.5 parts by weight of hydrophobic silica (AEROSIL RY-50, trade name, manufactured by Nippon Aerosil Co., Ltd.) are added to 100 parts by weight of the obtained yellow toner particles, and mixed using a Henschel-mixer at 22 m/s for 5 minutes. Thereafter, the toner particles are sieved with a vibration sieve having an opening of 45 μm, and yellow toner Y1 is obtained.

—Preparation of Yellow Toner Y2—

Yellow toner Y2 is obtained in a manner similar to the preparation of yellow toner Y1, except that yellow colorant particle dispersion Y3 is used in place of yellow colorant particle dispersion Y1.

—Preparation of Yellow Y3—

Yellow toner Y3 is obtained in a manner similar to the preparation of yellow toner Y1, except that yellow colorant particle dispersion Y4 is used in place of yellow colorant particle dispersion Y2.

—Preparation of Yellow Toner Y4—

Yellow toner Y4 is obtained in a manner similar to the preparation of yellow toner Y1, except that resin particle dispersion 2 is used in place of resin particle dispersion 1.

—Preparation of Yellow Toner Y5—

101 parts of isophthalic acid, 180 parts of bisphenol A (2 mole propylene oxide adduct) and 5.4 parts of dibutyl tin oxide are placed in a flask, and the mixture is subjected to a dehydration condensation reaction at a temperature of 230° C. under a nitrogen atmosphere for 16 hours. The weight average molecular weight of the obtained polyester resin is 4,800.

174 parts of this polyester resin, 8 parts of C. I. Pigment Yellow 185 (PY 185, manufactured by BASF SE), 8 parts of C. I. Pigment Yellow 74 (PY 74, SEIKA FAST YELLOW 2054, trade name, manufactured by Dainichiseika Color & Chemicals Mfg. Co., Ltd.) and 10 parts of Carnauba wax (HNP-9, trade name, manufactured by Nippon Seiro Co., Ltd.) are placed in a Banbury mixer (manufactured by Kobe Steel, Ltd.) and a pressure is applied thereto to adjust the inner temperature to 110±5° C., and the mixture is kneaded at 80 rpm for 10 minutes. After cooling, the kneaded product is coarsely pulverized using a hummer mill, and then finely pulverized to the size of about 6.8 μm using a jet mill. The obtained particles are classified with an elbow jet classifier (available from Matsubo Corporation), and yellow toner Y5 having a volume average particle size of 7.5 μm is thus obtained.

—Preparation of Cyan Toner C1—

Cyan toner C1 is obtained in a manner similar to yellow toner Y1, except that 18 parts by weight of cyan colorant particle dispersion C1 is used in place of yellow colorant particle dispersion Y1 and yellow colorant particle dispersion Y2.

—Preparation of Cyan Toner C2—

Cyan toner C2 is obtained in a manner similar to yellow toner Y4, except that 18 parts by weight of cyan colorant particle dispersion C1 is used in place of yellow colorant particle dispersion Y1 and yellow colorant particle dispersion Y2.

—Preparation of Cyan Toner C3—

Cyan toner C3 having a volume average particle size of 7.5 μm is prepared in a manner similar to yellow toner Y5, except that 16 parts of a cyan pigment (Pigment Blue (PB 15-3), trade name, manufactured by Dainichiseika Color & Chemicals Mfg. Co., Ltd.) is used in place of C. I. Pigment Yellow 185 and C. I. Pigment Yellow 74.

Preparation of Developer

<Preparation of Two-Component Developer>

Combination of the toner and the carrier as described in Tables 3 and 4 in an amount ratio of 8:92 are mixed and stirred using a V-blender at a revolution of 30 times/minute for 20 minutes, respectively, and yellow two-component developers and cyan two-component developers are prepared.

Evaluation

A green fixed image is formed from the yellow two-component developers and cyan two-component developers as prepared in accordance with the combinations described in Tables 3 and 4, and a light-fastness test is conducted after outputting a predetermined number of sheets and a color hue of a sample after a lapse of predetermined time is evaluated.

A green image (a solid patch image formed from 4 g/m$^2$ of yellow toner and 4 g/m$^2$ of cyan toner) is printed on an A4 paper sheet (J paper, manufactured by Fuji Xerox Co., Ltd.) using a printer (APEOSPORT-II C4300, trade name, modified so as to operate without including other developers than the yellow and cyan developers), and a light-fastness test is conducted using this image as a fixed image (a patch image at an initial stage).

Then, after outputting 10,000 blank sheets (i.e., the development process is conducted but no image is formed), a patch image as described above (patch image after 10,000 blank sheets) is formed as a fixed image and a light-fastness test is conducted using this image. Further, another 10,000 blank sheets are outputted and a patch image (patch image after 20,000 blank sheets) is formed as a fixed image and a light-fastness test is conducted using this image. Thereafter, another 20,000 blank sheets are outputted and a patch image (patch image after 40,000 blank sheets) is formed as a fixed image and a light-fastness test is conducted using this image.

The light-fastness test is performed by irradiating the patch image with light using a xenon light source (CPS+, trade name, manufactured by Atlas Material Testing Technology LLC) for 240 hours. The evaluation is performed by measuring the density of a yellow color component using a color measurement instrument (X-Rite 938, trade name, manufactured by X-Rite Incorporated). When the density of yellow color component is 1.0 or higher, the result is determined to be within a tolerable level. When the density of yellow color component is less than 1.0, further evaluations are not performed. The symbol "-" shown in Tables 3 and 4 indicates that the evaluation is not performed. The results of the evaluations are shown in Tables 3 and 4.

TABLE 3

| | Yellow | | Cyan | | Evaluation of Light-fastness | | | |
|---|---|---|---|---|---|---|---|---|
| | Two-component developer | | Two-Component Developer | | | After 10,000 | After 20,000 | After 40,000 |
| | Toner | Carrier | Toner | Carrier | Initial | Sheets | Sheets | Sheets |
| Example 1 | Y1 | 1 | C1 | 1 | 1.6 | 1.6 | 1.6 | 1.5 |
| Example 2 | Y1 | 2 | C1 | 1 | 1.6 | 1.6 | 1.6 | 1.4 |
| Example 3 | Y1 | 3 | C1 | 1 | 1.6 | 1.6 | 1.6 | 1.4 |
| Example 4 | Y1 | 4 | C1 | 1 | 1.6 | 1.6 | 1.6 | 1.4 |
| Example 5 | Y1 | 5 | C1 | 1 | 1.6 | 1.6 | 1.6 | 1.4 |
| Example 6 | Y1 | 6 | C1 | 1 | 1.6 | 1.6 | 1.6 | 1.3 |

TABLE 3-continued

| | Yellow | | Cyan | | Evaluation of Light-fastness | | | |
|---|---|---|---|---|---|---|---|---|
| | Two-component developer | | Two-Component Developer | | | After 10,000 | After 20,000 | After 40,000 |
| | Toner | Carrier | Toner | Carrier | Initial | Sheets | Sheets | Sheets |
| Example 7 | Y1 | 7 | C1 | 1 | 1.6 | 1.6 | 1.6 | 1.3 |
| Example 8 | Y1 | 8 | C1 | 1 | 1.6 | 1.6 | 1.6 | 1.3 |
| Example 9 | Y1 | 9 | C1 | 1 | 1.6 | 1.6 | 1.6 | 1.3 |
| Example 10 | Y1 | 10 | C1 | 1 | 1.6 | 1.6 | 1.4 | 1.2 |
| Example 11 | Y1 | 11 | C1 | 1 | 1.6 | 1.6 | 1.4 | 1.2 |
| Example 12 | Y1 | 12 | C1 | 1 | 1.6 | 1.6 | 1.4 | 1.2 |
| Example 13 | Y1 | 13 | C1 | 1 | 1.6 | 1.6 | 1.4 | 1.2 |
| Example 14 | Y1 | 14 | C1 | 1 | 1.6 | 1.6 | 1.3 | 1.1 |
| Example 15 | Y1 | 15 | C1 | 1 | 1.6 | 1.6 | 1.3 | 1.1 |
| Example 16 | Y1 | 16 | C1 | 1 | 1.6 | 1.6 | 1.3 | 1.1 |
| Example 17 | Y1 | 17 | C1 | 1 | 1.6 | 1.6 | 1.3 | 1.1 |
| Example 18 | Y1 | 18 | C1 | 1 | 1.6 | 1.4 | 1.2 | 1.1 |
| Example 19 | Y1 | 19 | C1 | 1 | 1.6 | 1.4 | 1.2 | 1.1 |
| Example 20 | Y1 | 20 | C1 | 1 | 1.6 | 1.4 | 1.2 | 1.1 |
| Example 21 | Y1 | 21 | C1 | 1 | 1.6 | 1.4 | 1.2 | 1.1 |
| Example 22 | Y1 | 22 | C1 | 1 | 1.6 | 1.4 | 1.2 | 1 |
| Example 23 | Y1 | 23 | C1 | 1 | 1.6 | 1.4 | 1.2 | 1 |

TABLE 4

| | Yellow | | Cyan | | Evaluation of Light-fastness | | | |
|---|---|---|---|---|---|---|---|---|
| | Two-Component Developer | | Two-Component Developer | | | After 10,000 | After 20,000 | After 40,000 |
| | Toner | Carrier | Toner | Carrier | Initial | Sheets | Sheets | Sheets |
| Example 24 | Y1 | 24 | C1 | 1 | 1.6 | 1.4 | 1.2 | 1 |
| Example 25 | Y1 | 25 | C1 | 1 | 1.6 | 1.4 | 1.2 | 1 |
| Example 26 | Y1 | 26 | C1 | 1 | 1.6 | 1.2 | 1.1 | 0.8 |
| Example 27 | Y1 | 27 | C1 | 1 | 1.6 | 1.2 | 1.1 | 0.8 |
| Example 28 | Y1 | 28 | C1 | 1 | 1.6 | 1.2 | 1.1 | 0.8 |
| Example 29 | Y1 | 29 | C1 | 1 | 1.6 | 1.2 | 1.1 | 0.8 |
| Example 30 | Y1 | 30 | C1 | 1 | 1.6 | 1.2 | 0.8 | — |
| Example 31 | Y1 | 31 | C1 | 1 | 1.6 | 1.2 | 0.8 | — |
| Example 32 | Y1 | 32 | C1 | 1 | 1.6 | 1.2 | 0.8 | — |
| Example 33 | Y1 | 33 | C1 | 1 | 1.6 | 1.2 | 0.8 | — |
| Example 34 | Y1 | 34 | C1 | 1 | 1.6 | 1.1 | 0.7 | — |
| Example 35 | Y1 | 35 | C1 | 1 | 1.6 | 1.1 | 1 | 0.8 |
| Example 36 | Y1 | 36 | C1 | 1 | 1.6 | 1.1 | 1 | 0.7 |
| Example 37 | Y1 | 37 | C1 | 1 | 1.6 | 1.1 | 0.7 | — |
| Example 38 | Y2 | 1 | C1 | 1 | 1.6 | 1.6 | 1.6 | 1.4 |
| Example 39 | Y3 | 1 | C1 | 1 | 1.6 | 1.6 | 1.5 | 1.3 |
| Example 40 | Y4 | 1 | C2 | 1 | 1.6 | 1.5 | 1.4 | 1.2 |
| Example 41 | Y5 | 1 | C3 | 1 | 1.6 | 1.4 | 1.4 | 1.1 |
| Comparative Example 1 | Y1 | 38 | C1 | 1 | 1.6 | 0.9 | — | — |
| Comparative Example 2 | Y1 | 39 | C1 | 1 | 1.6 | 0.8 | — | — |
| Comparative Example 3 | Y1 | 40 | C1 | 1 | 1.6 | 0.9 | — | — |
| Comparative Example 4 | Y1 | 41 | C1 | 1 | 1.6 | 0.8 | — | — |

As shown in Tables 3 and 4, the two-component developers as prepared in the Examples exhibit a superior light-fastness over the long period of time, as compared with the two-component developers as prepared in the Comparative Examples.

All publications, patent applications, and technical standards mentioned in this specification are herein incorporated by reference to the same extent as if each individual publication, patent application, or technical standard was specifically and individually indicated to be incorporated by reference.

What is claimed is:

1. A two-component developer comprising:

a yellow toner; and a carrier, the yellow toner comprising at least one of C. I. Pigment Yellow 155 or C. I. Pigment Yellow 185, and an azo pigment, and the carrier comprising a first resin, magnetic particles dispersed in the first resin, and elements of Mn, Cu, Zn, and Ni each in an amount of 0.1 ppm or more, wherein a total amount of the elements of Mn, Cu, Zn, and Ni in the carrier is 92 ppm or less.

2. The two-component developer according to claim 1, wherein each of the elements of Cu, Zn, Ni and Mn are present in the carrier in an amount of at least 10 ppm.

3. The two-component developer according to claim 1, wherein the azo pigment comprises at least one selected from a group consisting of a monoazo pigment, a disazo pigment and an azo lake pigment.

4. The two-component developer according to claim 1, wherein the azo pigment comprises C. I. Pigment Yellow 74.

5. The two-component developer according to claim 1, wherein a total amount of the at least one of C. I. Pigment Yellow 155 or C. I. Pigment Yellow 185, and the azo pigment is from about 0.1 parts by weight to about 20 parts by weight, with respect to 100 parts by weight of the yellow toner.

6. The two-component developer according to claim 1, wherein a content ratio of the at least one of C. I. Pigment Yellow 155 or C. I. Pigment Yellow 185 to the azo pigment is from about 99.5:0.5 to about 5:95.

7. The two-component developer according to claim 1, wherein the yellow toner further comprises a second resin, the second resin comprising a polycondensation resin.

8. The two-component developer according to claim 7, wherein a weight average molecular weight of the polycondensation resin is from about 1,500 to about 40,000.

9. The two-component developer according to claim 7, wherein an acid number of the polycondensation resin is from about 1 mg·KOH/g to about 50 mg·KOH/g.

10. The two-component developer according to claim 7, wherein the yellow toner comprises the second resin in an amount of from about 10% by weight to about 90% by weight with respect to a total amount of the yellow toner.

11. The two-component developer according to claim 1, wherein the yellow toner comprises a release agent in an amount of from about 0.5% by weight to about 50% by weight with respect to a total amount of the yellow toner.

12. The two-component developer according to claim 1, wherein the yellow toner comprises inorganic particles having a primary particle size of from about 5 nm to about 1 μm.

13. The two-component developer according to claim 12, wherein the inorganic particles have a specific surface area, as measured by a BET method, of from about 20 $m^2/g$ to about 500 $m^2/g$.

14. The two-component developer according to claim 1, wherein the yellow toner has a volume average particle size of from about 2 μm to about 10 μm.

15. The two-component developer according to claim 1, wherein the carrier comprises a core material formed from the first resin and the magnetic particles dispersed in the first resin, and a third resin that coats the core material.

16. The two-component developer according to claim 15, wherein the first resin comprises a crosslinkable resin.

17. The two-component developer according to claim 16, wherein the crosslinkable resin comprises a phenol resin.

18. The two-component developer according to claim 15, wherein an amount of the magnetic particles is from about 80% by weight to about 99% by weight with respect to a total amount of the core material.

19. The two-component developer according to claim 15, wherein an amount of the third resin is from about 1% by weight to about 5% by weight with respect to a total amount of the carrier.

* * * * *